US006333670B1

(12) United States Patent
Kono et al.

(10) Patent No.: US 6,333,670 B1
(45) **Date of Patent: *Dec. 25, 2001**

(54) SEMICONDUCTOR DEVICE CAPABLE OF STABLY GENERATING INTERNAL VOLTAGE WITH LOW SUPPLY VOLTAGE

(75) Inventors: Takashi Kono; Takeshi Hamamoto, both of Hyogo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,521

(22) Filed: Dec. 8, 1999

(30) Foreign Application Priority Data

Jun. 9, 1999 (JP) ..... 11-162084

(51) Int. Cl.[7] ..... G05F 1/10
(52) U.S. Cl. ..... 327/541; 327/540; 323/313
(58) Field of Search ..... 327/538, 540, 327/541, 543; 323/313, 315, 316

(56) References Cited

U.S. PATENT DOCUMENTS

| | | | | |
|---|---|---|---|---|
| 5,467,052 | * | 11/1995 | Tsukada | 327/543 |
| 5,534,817 | * | 7/1996 | Suzuki et al. | 327/545 |
| 5,687,123 | | 11/1997 | Hidaka et al. | 365/189 |
| 5,689,460 | * | 11/1997 | Ooishi | 327/538 |
| 5,757,175 | * | 5/1998 | Morishita et al. | 327/315 |
| 5,936,455 | * | 8/1999 | Kobayashi et al. | 327/541 |

OTHER PUBLICATIONS

"An Experimental 256–Mb DRAM with Boosted Sense–Ground Scheme", M. Asakura et al., IEEE Journal of Solid–State Circuits, vol. 29, No. 11, Nov. 1994, pp. 1303–1309.

* cited by examiner

*Primary Examiner*—Terry D. Cunningham
(74) *Attorney, Agent, or Firm*—McDermott, Will & Emery

(57) ABSTRACT

Change in internal voltage on an internal voltage line is detected as discharging current of a capacitance element via an MOS transistor to change a charged voltage of the capacitance element. According to the charged voltage of the capacitance element, a current drive transistor is driven to supply a current to the internal voltage line. The internal voltage is stably generated with low current consumption and small occupation area.

14 Claims, 9 Drawing Sheets

SEMICONDUCTOR DEVICE CAPABLE OF STABLY GENERATING INTERNAL VOLTAGE WITH LOW SUPPLY VOLTAGE

BACKGROUND OF THE INVENTION

1. Field of the Invention

The present invention relates to semiconductor devices, and particularly to a semiconductor device which internally generates a necessary voltage. In particular, the present invention relates to a structure for stably generating an internal voltage under a low power supply voltage level.

2. Description of the Background Art

With development and prevalence of communication and information processing equipments, various semiconductor devices are employed in those equipments. Higher performance is required for such semiconductor devices, while integrity in specification between components is becoming important since the semiconductor device is mounted on a board together with other devices and components. One example of the specification requiring the consistency is a voltage supplied to a plurality of semiconductor devices (components). If all of the devices and components operate with a common voltage, design of a power supply on the board is simplified. Therefore, one semiconductor chip (device) is basically required to operate receiving one kind of supply voltage (except for ground voltage).

However, a voltage having the same voltage level as that of external supply voltage extVdd is not always available as for a voltage supplied to a circuit within the semiconductor device (chip). As the operating speed and integration are advanced, a transistor is considerably decreased in dimension. In the case of MOS transistor (insulated gate field effect transistor), for example, external supply voltage extVdd is too high in view of the reliability of a gate insulating film and the breakdown voltage between the drain and source, and thus cannot directly be used for driving the MOS transistor. Accordingly, external supply voltage extVdd is internally converted to a required voltage level for application to an internal circuit.

FIG. 13 illustrates a structure of a conventional internal voltage down converter VDC. Referring to FIG. 13, internal voltage down converter VDC includes a comparator CMP for comparing a reference voltage Vrefs with an internal (power supply) voltage Vdds, and a current drive transistor DR for supplying current from an external power supply node to an internal voltage line according to an output signal of comparator CMP.

Comparator CMP includes p channel MOS transistors Q1 and Q2 coupled to the external supply node to supply current, n channel MOS transistors Q3 and Q4 receiving current from MOS transistors Q1 and Q2 to compare reference voltage Vrefs with internal voltage Vdds, and an n channel MOS transistor Q5 providing a path for causing an operating current flow through comparator CMP in response to an activation signal VDCON. MOS transistor Q2 has its gate and drain connected together to the gate of MOS transistors Q1, and MOS transistors Q1 and Q2 constitute a current mirror circuit.

Current drive transistor DR is constituted of a p channel MOS transistor.

In the structure of internal voltage down converter VDC shown in FIG. 13, when activation signal VDCON is at an L (logical low) level, MOS transistor Q5 is in OFF state, an output signal of comparator CMP is at the level of external supply voltage extVdd, and accordingly current drive transistor DR is in OFF state.

When activation signal VDCON attains an H (logical high) level, MOS transistor Q5 attains ON state and comparator CMP responsively starts a comparing operation. When internal voltage Vdds is higher than reference voltage Vrefs, an output signal of comparator CMP attains H level so that current drive transistor DR maintains OFF state. When internal voltage Vdds is lower than reference voltage Vrefs, an output signal of comparator CMP lowers so that current drive transistor DR supplies current from the external supply node to the internal voltage line according to the output signal of comparator CMP. As a result, the voltage level of internal voltage Vdds rises. Internal voltage Vdds is thus maintained at the level of reference voltage Vrefs.

Internal voltage Vdds from internal voltage down converter VDC is at the same level as that of reference voltage Vrefs and lower than external supply voltage extVdd, and is supplied to an internal circuit as an operating supply voltage, for example.

Concerning such internal voltage, there are a plurality of kinds in most cases. In a semiconductor memory device, for example, there are two kinds of internal voltages, or the voltage transmitted to a memory array and the voltage for operating peripheral circuitry. Voltage of a required intermediate level is also generated by a voltage down converter as shown in FIG. 13. Among these internal voltages, a voltage Vrl at a relatively low voltage level is usually used for reducing current consumption.

FIG. 14A illustrates one example of the usage of voltage Vrl. In FIG. 14A, voltage Vrl is utilized for adjusting an amount of current driven by a current source transistor Q6 of an internal circuit NK. If the level of voltage Vrl is low, the conductance of current source transistor Q6 is also small so that through current Ic in internal circuit NK can be reduced. In other words, standby current flowing in a standby state can be decreased and accordingly, battery-driven equipments can be operated for a long period of time with one battery.

FIG. 14B illustrates another usage of internal voltage Vrl. In the structure shown in FIG. 14B, transmission gates TG1 and TG2 are selectively set into conductive state by switch signal HS to supply one of internal voltages Vh and Vrl to the gate of current drive transistor Q6. Internal voltage Vh is higher than internal voltage Vrl.

When switch signal HS is at L level, an output signal of an inverter IV1 attains H level, and responsively transmission gate TG1 becomes conductive and internal voltage Vh is supplied to the gate of current drive transistor Q6. At this time, operating current (through current) Ic of internal circuit NK increases to allow internal circuit NK to operate at a high speed. On the other hand, when switch signal HS is at H level, an output signal of inverter IV1 falls to L level, and responsively transmission gate TG2 becomes conductive and internal voltage Vrl is supplied to the gate of current drive transistor Q6 and through current Ic is decreased.

According to the structure shown in FIG. 14B, the amount of current driven by current source drive transistor Q6 is adjusted according to an operation mode so as to decrease current consumption in the standby state and to implement a circuit operating at a high speed. Since through current Ic is changed depending on the operation mode switch signal HS, it is unnecessary to place a plurality of current source transistors and set these transistors selectively into ON state according to the operation mode. Consequently, the number of current source transistors can be decreased to reduce the area occupied by the entire circuit.

FIG. 15A illustrates a further usage of internal voltage Vrl. In the structure shown in FIG. 15A, internal voltage Vrl is supplied to the source of an n channel MOS transistor Q7. The drain of MOS transistor Q7 is coupled to receive a supply voltage Vd. Ground voltage GND is supplied to the gate of MOS transistor Q7. Internal voltage Vrl is a positive voltage and the gate-source voltage Vgs of the MOS transistor is negative, reducing leakage current (subthreshold current) Ioff. In this case, if back gate bias of MOS transistor Q7 is lower than internal voltage Vrl applied to the source thereof, substrate-source voltage Vbs increases in a negative direction and the threshold voltage of MOS transistor Q7 increases owing to the back gate bias effect. Accordingly, subthreshold current ioff can further be decreased.

The voltage application system illustrated in FIG. 15A is applied to a memory cell of a DRAM (Dynamic Random Access Memory). The voltage application scheme for decreasing the leakage current is referred to as Boosted Sense Ground (BSG) scheme as discussed by Asakura et al. in ISSCC, Digest of Technical Papers, 1994, pp. 1303–1309.

FIG. 15B illustrates voltage application to a memory cell according to the BSG scheme. Memory cell MC includes a memory capacitor Ms for storing information, and an access transistor MT for connecting a memory capacitor Ms to a bit line BL (or /BL) according to a signal voltage on a word line WL. Access transistor MT is constituted of an n channel MOS transistor, and has its gate connected to word line WL, its drain connected to bit line BL (or/BL) and its back gate receiving a constant bias voltage Vbb.

In a standby cycle, bit line BL is maintained at an intermediate voltage level and word line WL is at ground voltage GND level. Suppose that an active cycle now starts a memory cell is selected, and L level data is transmitted to bit line BL. If memory cell MC is a non-selected memory cell, the voltage on word line WL is at ground voltage GND level. Therefore, if voltage Vbsg corresponding to L level data on bit line BL is at internal voltage Vrl level, gate-source voltage Vgs of access transistor MT is a negative voltage. Further, the difference between back gate voltage Vbb of access transistor MT and voltage Vbsg on bit line BL increases in a negative direction so that leakage current flowing from memory capacitor Ms to bit line BL via access transistor MT is decreased. In other words, in the active cycle, reduction in voltage level of H level data in the non-selected memory cell is avoided, refresh characteristics are improved, and data holding time can be increased.

Utilization of such low level internal voltage Vrl is indispensable for achieving low current consumption of a semiconductor device. However, it is difficult to stably generate a voltage that is close to the threshold voltage of an n channel MOS transistor as internal voltage Vrl. For example, when n channel MOS transistor is diode-connected to generate internal voltage Vrl, the level of internal voltage Vrl changes according to the temperature characteristics of the threshold voltage of the MOS transistor, leading to a significant temperature dependency of internal voltage Vrl. In order to avoid this problem of temperature dependency, the voltage down converter as shown in FIG. 13 is employed, for example. In this case, reference voltages Vrefs and Vdds correspond to the voltage close to the threshold voltages of MOS transistors Q3 and Q4. The common source node of MOS transistors Q3 and Q4 is connected to the ground node via MOS transistor Q5. The common source node of these MOS transistors Q3 and Q4 is at a voltage level higher than the ground voltage due to the channel resistance of MOS transistor Q5. Even if the voltage at a level close to the threshold voltages of MOS transistors Q3 and Q4 is supplied to the gates of MOS transistors Q3 and Q4, MOS transistors Q3 and Q4 are substantially in OFF state and cannot perform a comparing operation.

FIG. 16 illustrates one example of the structure of a conventional Vrl generating circuit. Referring to FIG. 16, the Vrl generating circuit includes a p channel MOS transistor Q10 connected between an external supply node and a node NA and receiving ground voltage GND at its gate, a p channel MOS transistor Q11 connected between node NA and a node NB and receiving a reference voltage Vr10 at its gate, a p channel MOS transistor Q12 connected between node NA and a node NC and receiving the internal voltage Vrl at its gate, an n channel MOS transistor Q13 connected between node NB and a ground node and having its gate connected to node NB, and an n channel MOS transistor Q14 connected between node NC and the ground node and having its gate connected to node NB. MOS transistor Q13 and Q14 constitute a current mirror circuit.

In the structure shown in FIG. 16, when internal voltage Vrl is higher than reference voltage Vr10, the current flowing through MOS transistor Q11 is greater in amount than the current flowing through MOS transistor Q12. MOS transistors Q13 and Q14 allow current to flow therethrough which is the same in magnitude as the current flowing through MOS transistor Q11. Accordingly, the voltage level of node NC, i.e. the voltage level of internal voltage Vrl decreases.

On the contrary, when internal voltage Vrl is lower than reference voltage Vr10, the current flowing through MOS transistor Q12 is greater in amount than the current flowing through MOS transistor Q11. MOS transistor Q14 cannot discharge all the current supplied from MOS transistor Q12, and the level of internal voltage Vrl from node NC increases.

In other words, internal voltage Vrl is maintained at the level of reference voltage Vr10.

According to the structure of the Vrl generating circuit shown in FIG. 16, internal voltage Vrl is generated by the source current of MOS transistor Q12. Therefore, through current Ica of the Vrl generating circuit has to be increased. Especially, if internal voltage Vrl is used for a DRAM of the BSG scheme as shown in FIG. 15B, internal voltage Vrl is used for discharging the bit lines and thus a great current driving capability is required for the internal voltage generating circuit (in order to prevent increase of the voltage level of internal voltage Vrl due to discharging current). In the case of the structure shown in FIG. 16, the MOS transistor of a component should be increased in size (the ratio between the gate width and the gate length), leading to increase in the circuit occupation area and increase in current consumption.

FIG. 17 illustrates another structure of the conventional Vrl generating circuit. The Vrl generating circuit shown in FIG. 17 includes a comparator CMPP for comparing reference voltage Vr10 with internal voltage Vrl on an internal voltage line INV, and a current drive transistor NQ for discharging internal voltage line INV to a ground voltage level according to an output signal of comparator CMPP. Current drive transistor NQ is constituted of an n channel MOS transistor.

Comparator CMPP includes a p channel MOS transistor Q15 connected between an external supply node and an internal node ND and having its gate connected to a ground node, a p channel MOS transistor Q16 connected between internal node ND and an internal node NE and having its gate receiving reference voltage Vrl0, a p channel MOS transistor Q17 connected between internal node ND and an internal node NF and having its gate connected to internal voltage line INV, an n channel MOS transistor Q18 connected between internal node NE and the ground node and having its gate connected to internal node NF, and an n channel MOS transistor Q19 connected between internal node NF and the ground node and having its gate connected to internal node NF.

Comparator CMPP shown in FIG. 17 is equivalent to comparator shown in FIG. 13 with voltage polarity and conductivity types of transistors reversed. If internal voltage Vrl is higher than reference voltage Vrl0, the current flowing through MOS transistor Q17 is smaller in amount than the current flowing through MOS transistor Q16. MOS transistors Q18 and Q19 constitute a current mirror circuit and thus current of the same magnitude flows through MOS transistors Q18 and Q19. Consequently, an output signal from comparator CMPP attains a high level and the conductance of current drive transistor NQ increases so that current is discharged from internal voltage line INV to the ground node to decrease the voltage level of internal voltage Vrl. On the other hand, if internal voltage Vrl is lower than reference voltage Vrl0, an output signal of comparator CMPP is at L level to turn off current drive transistor NQ.

In the structure of the Vrl generating circuit shown in FIG. 17, if the speed of response to change in internal voltage Vrl is placed out of consideration, DC-wise current supplying capability can be increased by decreasing through current Icb while increasing the ratio between the channel width and the channel length of current drive transistor NQ for enhancing the current driving-power thereof, without increase in the occupying area. However, in view of an allowable range of change in internal voltage Vrl, the necessary minimum speed of response to internal voltage Vrl is required, and through current Icb is required to have a certain magnitude.

Utilization of the Vrl generating circuit as shown in FIG. 17 enables internal voltage Vrl having a great current supplying ability generation of with a small occupation area. However, in comparator CMPP, reference voltage Vrl0 and internal voltage Vrl are compared by p channel MOS transistors Q16 and Q17. The sources of MOS transistors Q16 and Q17 correspond to node ND. The current driving power of p channel MOS transistor Q17 is determined by gate-source voltage Vgs thereof. If external supply voltage extVdd transmitted to node ND changes, the current flowing through MOS transistors Q16 and Q17 changes in proportion to the square of the difference between gate-source voltage Vgs of MOS transistors Q16 and 17 and the threshold voltage thereof (MOS transistors Q16 and Q17 operate in a saturation region). Therefore, the level of internal voltage Vrl cannot be maintained at reference voltage Vrl0 level in a stable manner so that the level of internal voltage Vrl changes according to external supply voltage extVdd.

In order to solve the problem of power supply noise of external supply voltage extvdd, another internal voltage Vdd' might be used which is in a stable state even when internal voltage Vrl is consumed. However, another circuit for generating internal voltage Vdd' should be provided only for the stable operation of internal voltage Vrl, leading to increase in the circuit area.

SUMMARY OF THE INVENTION

One object of the present invention is to provide a semiconductor device capable of stably generating internal voltage of a desired voltage level with a simple circuit structure and without increase in occupation area.

Another object of the invention is to provide a semiconductor device capable of internally generating an internal voltage of a low level stably.

A semiconductor device according to the present invention includes an internal voltage line and an internal voltage generating circuit for generating an internal voltage on the internal voltage line. The internal voltage generating circuit includes a reference voltage generating circuit, a capacitance element, a difference detection circuit for changing the charged voltage of the capacitance element according to a difference between the reference voltage from the reference voltage generating circuit and the internal voltage on the internal voltage line, and a current drive element for causing a current flow between a power supply node and the internal voltage line according to the charged voltage of the capacitance element.

The charged voltage of the capacitance element is changed according to the difference between the reference voltage and the internal voltage, and the internal voltage is accordingly generated by driving the current drive element based on the charged voltage. In other words, a slight change in the internal voltage is amplified by a change in accumulated charge amount of the capacitance element to drive the current drive element. Accordingly, in response to change in the internal voltage speedily, the change in the internal voltage can be recovered via the current drive element. Charging/discharging of the capacitance element is merely utilized and the change in the internal voltage can be detected with a simple circuit structure. Further, mere driving of a control electrode node of the current drive element is required for the capacitance element, and the area occupied by the capacitance element can be decreased and accordingly the area occupied by the circuit can be reduced.

Further, the difference between the reference voltage and the internal voltage is represented by the change in the charged voltage of the capacitance element. As a result, the current drive element can be driven without influence of change in the supply voltage such as the external supply voltage.

Utilizing the current drive element, internal voltage can be generated with a great current driving power.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
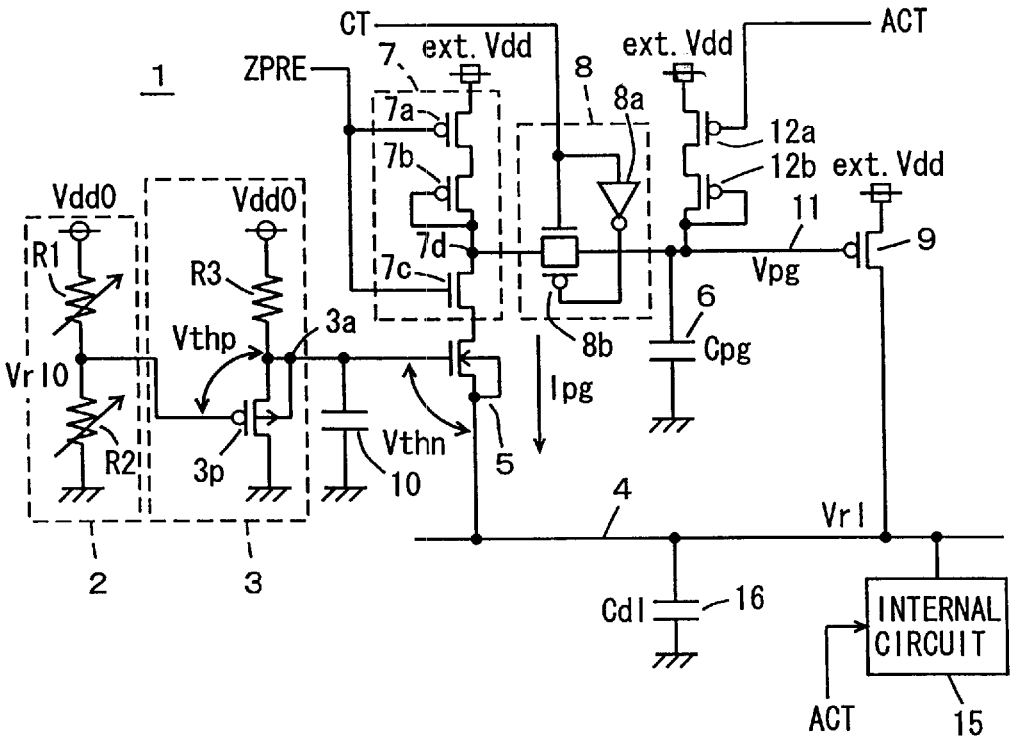
FIG. 1A illustrates a structure of an internal voltage generating circuit according to a first embodiment of the invention.

FIG. 1A illustrates a structure of an internal voltage generating circuit according to an first embodiment of the invention. Referring to FIG. 1A, the internal voltage generating circuit 1 includes a reference voltage generating circuit 2 generating reference voltage Vrl0, a level shift circuit 3 receiving reference voltage Vrl0 from reference voltage generating circuit 2 and performing level shifting on the reference voltage to generate reference voltage Vrl0+Vthp, an n channel MOS transistor 5 detecting the difference between the reference voltage from level shift circuit 3 and internal voltage Vrl on an internal voltage line 4 to cause a current flow according to the difference, a capacitance element 6 with charged voltage adjusted by difference detecting MOS transistor 5, a precharge circuit 7 precharging capacitance element 6 to a predetermined voltage, a charge holding circuit 8 for holding the charged electric charges of capacitance element 6, and a p channel MOS transistor 9 supplying current from an external supply node to internal voltage line 4 according to charged voltage Vpg of capacitance element 6.

Reference voltage generating circuit 2 includes variable resistance elements R1 and R2 connected in series between a node receiving internal reference voltage Vdd0 and a ground node. From a connection node between variable resistance elements R1 and R2, reference voltage Vrl0 is supplied. Regarding variable resistance elements R1 and R2, their resistance values can be adjusted using fuse elements, for example, the voltage level of reference voltage Vrl0 can accordingly be adjusted and reference voltage Vrl0 at an optimum level can be generated even if a process parameter or the like changes.

Level shift circuit 3 includes a resistance element R3 and a p channel MOS transistor 3p connected in series between an internal node and the ground node. The resistance value of resistance element R3 is set at a value sufficiently higher than a channel resistance (ON resistance) of p channel MOS transistor 3p. Therefore, p channel MOS transistor 3p operates in a source follower mode to maintain the source-gate voltage thereof at the voltage level of an absolute value Vthp of the threshold voltage thereof. The resistance value of resistance element R3 is large enough to decrease the current consumption in level shift circuit 3. This is because level shift circuit 3 is merely required to charge the gate capacitance of difference detecting MOS transistor 5 and thus no great current supplying ability is required.

Similarly, in reference voltage generating circuit 2, no current is consumed after charging of the gate capacitance of MOS transistor 3p. Accordingly, resistance values of resistance elements R1 and R2 can be made large enough to decrease current consumption.

MOS transistor 5 has a gate connected to the output node of level shift circuit 3 and a source connected to internal voltage line 4. When the difference between the output voltage of level shift circuit 3 and voltage Vrl on internal voltage line 4 reaches threshold voltage Vthn or more, MOS transistor 5 is turned on to flow a current. The gate of MOS transistor 5 is provided with a stabilization capacitance 10 for stabilizing the gate voltage of MOS transistor 5.

Precharge circuit 7 includes p channel MOS transistors 7*a* and 7*b* connected in series between an external supply node receiving external supply voltage extVdd and a node 7*d*, and an n channel MOS transistor 7*c* connected between node 7*d* and MOS transistor 5. MOS transistors 7*a* and 7*c* have respective gates receiving precharge instruction signal ZPRE. P channel MOS transistor 7*b* has its gate and drain connected to node 7*d*, operates in a diode mode to cause voltage drop corresponding to the absolute value of a threshold voltage thereof.

Charge holding circuit 8 includes an inverter 8*a* inverting a charge transfer instruction signal CT, and a transmission gate 8*b* rendered conductive according to charge transfer instruction signal CT and an output signal of inverter 8*a* to selectively connect a node 11 and node 7*d*. When transmission gate 8*b* enters a nonconductive state, capacitance element 6 is isolated from precharge circuit 7 and MOS transistor 5, so that a charging and discharging path of capacitance element 6 is cut off and stored charges of capacitance element 6 are held.

Internal voltage generating circuit 1 further includes p channel MOS transistors 12*a* and 12*b* connected between the external supply node and node 11. MOS transistor 12*a* has its gate receiving an activation instruction signal ACT, and MOS transistor 12*b* has its gate connected to node 11 and operates in a diode mode. Activation instruction signal ACT is used for activating an operation of an internal circuit 15 which consumes internal voltage Vrl on internal voltage line 4. Internal circuit 15 starts an operation when activation instruction signal ACT enters an active state of H level, and consumes internal voltage Vrl.

Figure 1B:
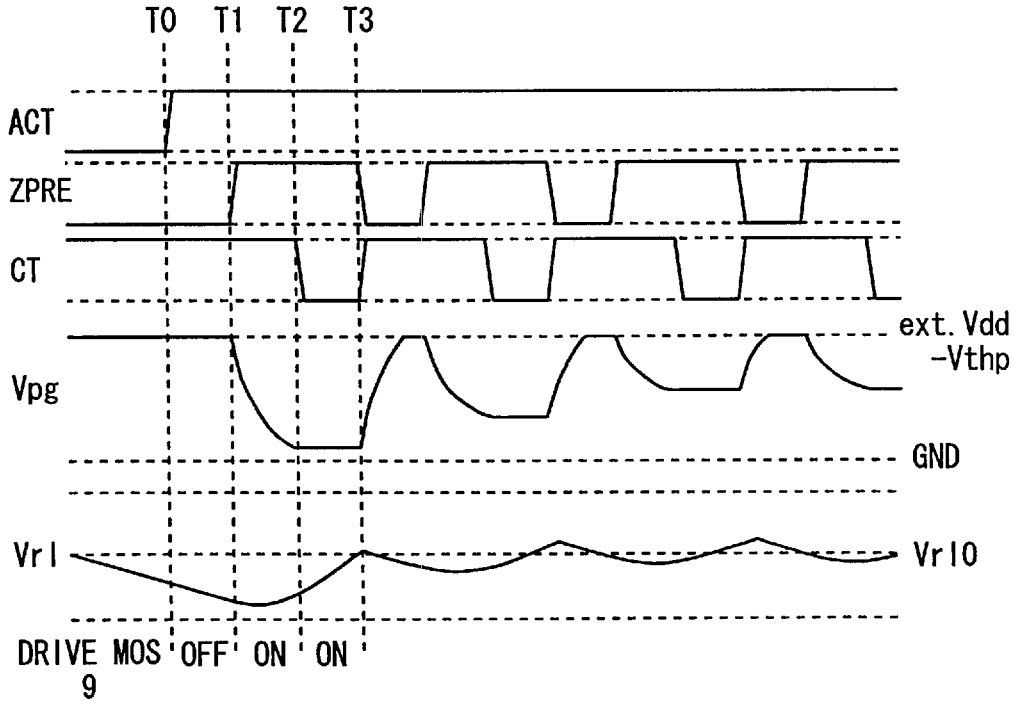
FIG. 1B is a timing chart illustrating an operation of the circuit shown in FIG. 1A.

Internal voltage line 4 is further connected to a stabilization capacitance 16 for stabilizing internal voltage Vrl. External supply voltage extVdd is 2.5V, for example. Internal reference voltage Vdd0 is 2.0V, for example, and is a constant voltage independent of external supply voltage extVdd. Reference voltage Vrl0 is 0.5V for example, and threshold voltages Vthp and Vthn are 0.6V, for example. An operation of the internal voltage generating circuit shown in FIG. 1A is now described in conjunction with the operation waveforms illustrated in FIG. 1B.

Before time T0, activation instruction signal ACT is in an inactive state of L level and internal circuit 15 does not operate. In this state, MOS transistor 12*a* is in ON state to precharge the node 11 to the voltage level of extVdd−Vthp. Voltage Vpg on node 11 equalizes the gate-source voltage of MOS transistor 9 to the threshold voltage thereof and MOS transistor 9 substantially maintains OFF state. It is now supposed that the threshold voltages of all p channel MOS transistors are the same. A leakage path between a node supplying a voltage lower than internal voltage Vrl (e.g. ground voltage GND) and internal voltage line 4 causes internal voltage Vrl to gradually decrease.

When activation instruction signal ACT is in the inactive state, precharge instruction signal ZPRE is in the activate state of L level, MOS transistors 7*a* and 7*c* are respectively in ON and OFF states in precharge circuit 7, and accordingly node 7*d* is precharged to the level of voltage extVdd−Vthp. Charge transfer instruction signal CT is at H level, transmission gate 8*b* is rendered conductive, and node 11 is precharged by precharge circuit 7 to the level of voltage extVdd−Vthp. These signals ZPRE and CT are periodically generated according to activation of activation instruction signal ACT. Details of the method of generating these signals are described later.

At time T0, activation instruction signal ACT is driven into the active state of H level, and internal circuit 15 starts its operation to consume internal voltage Vrl. Consequently, the voltage level of internal voltage Vrl further decreases. MOS transistor 12*a* enters OFF state in response to activation of activation instruction signal ACT.

At time T1, precharge instruction signal ZPRE rises to H level, MOS transistors 7*a* and 7*c* enter OFF and ON states, respectively, and accordingly a precharge operation for capacitance element 6 by precharge circuit 7 is completed. Since MOS transistor 12*a* is in OFF state, node 11 is isolated from the external supply node.

On the other hand, MOS transistor 5 is coupled to capacitance element 6 via MOS transistor 7*c* and transmission gate 8*b*. MOS transistor 5 receives voltage Vrl0+Vthp at its gate, and receives internal voltage Vrl at its source. Therefore, MOS transistor 5 attains ON state when the condition of the following relation (1) is satisfied to supply current from capacitance element 6 to internal voltage line 4:

$$Vrl0+Vthp>Vrl+Vthn. \quad (1)$$

If threshold voltage Vthp (represented in absolute value) is equal to threshold voltage Vthn, the level of internal voltage Vrl is controlled so as to equal to reference voltage Vrl0. Here, absolute value Vthp of the threshold voltage is hereinafter referred to simply as threshold voltage. If threshold voltages Vthp and Vthn are not equal to each other, the voltage level of reference voltage Vrl0 may appropriately be set by trimming of resistance values of resistance elements R1 and R2. Therefore, it is not important essentially whether or not absolute values Vthp and Vthn of the threshold voltages are equal to each other. It is supposed that the relation of Vthp=Vthn is satisfied for the purpose of simplification of the description.

Stored charges of capacitance element 6 are discharged to internal voltage line 4 via MOS transistor 5. Specifically, MOS transistor 5 discharges the current corresponding to the difference between the voltage on node 3*a* and internal voltage Vrl on internal voltage line 4, and accordingly the discharging current causes change in charged voltage Vpg of capacitance element 6. Capacitance value Cpg of capacitance element 6 is sufficiently smaller than capacitance value Cdl of stabilization capacitance 16, so that the current discharged by MOS transistor 5 significantly changes the charged voltage Vpg of capacitance element 6.

At time T2, charge transfer instruction signal CT falls to L level to turn off transmission gate 8*b*. The total amount of charges Qpg flowing onto internal voltage line 4 via MOS transistor 5 in time period T' between time T2 and time T1 is represented by the following equation.

$$Qpg=\int Ipg\cdot dT,$$

where the integration period T is represented by $T1<T<T'\leqq T2$.

The level of voltage Vpg on node 11 at time T' is represented by Equation (2) below.

$$Vpg=extVdd-Vthp-Qpg/(Cpg+Cg) \quad (2)$$

Cg in the above equation (2) represents a gate capacitance of driving MOS transistor 9 when driving MOS transistor 9 attains ON state to have a channel formed. MOS transistor 9 attains ON state when gate-source voltage Vgs becomes equal to the threshold voltage thereof. Specifically, when the relation (3) below is satisfied, the MOS transistor attains ON state.

$$Vpg<extVdd-Vthp \quad (3)$$

It would be understood from above relations (2) and (3), that driving MOS transistor 9 immediately attains ON state when discharging via MOS transistor 5 occurs, to supply current from the external supply node to internal voltage line 4.

According to above Equation (2), with a the smaller the capacitance value (Cpg+Cg) of node 11, a greater change of voltage Vpg on node 11 is caused even by a slight amount of discharging current Qpg. In other words, even if internal voltage Vrl is slightly deviated from reference voltage Vrl0, discharging current via MOS transistor 5 causes a great change in voltage Vpg of node 11, current immediately flows via driving MOS transistor 9 from the external supply node into internal voltage line 4, increasing the voltage level of internal voltage Vrl.

At time T2, charge transfer instruction signal CT attains the inactive state of L level, transmission gate 8*b* enters the nonconductive state, capacitance element 6 and MOS transistor 5 are isolated, and voltage Vpg on node 11 is accordingly maintained at the voltage level at time T2. In this state, driving MOS transistor 9 supplies a constant current to internal voltage line 4. The reason why voltage Vpg on node 11 is maintained at a constant value is described below.

If charge transfer instruction signal CT is maintained in the active state of H level, the level of voltage Vpg on node 11 continuously decreases so long as Equation (1) is satisfied even if the voltage level of internal voltage Vrl begins to rise. Consequently, the current supplying ability of driving MOS transistor 9 is increasingly enhanced and the current is supplied to internal voltage line 4 more than necessary, so that internal voltage Vrl overshoots and accordingly exceeds a predetermined voltage level. As a result, it becomes impossible to guarantee a stable operation of internal circuit 15. In order to prevent the overshooting, charge transfer instruction signal CT is set into the inactive state at time T2, voltage Vpg on node 11 is maintained at a constant voltage level to maintain the current supplying ability of driving MOS transistor 9 at a constant level.

At time T3, precharge instruction signal ZPRE attains the active state, charge transfer instruction signal CT also attains the active state, MOS transistor 5 and capacitance element 6 are isolated, node 11 is precahrged by precharge circuit 7 again to the voltage level of extVdd−Vthp and accordingly preparation is made for the following voltage difference detecting operation.

During a period in which activation instruction signal ACT is in the active state, the precharging operation, the voltage difference detecting operation, and the voltage maintaining operation for voltage Vpg on node 11 as described above are repeated. Owing to these operations, internal voltage Vrl is so controlled as to be equal to reference voltage Vrl0.

The amount of current Ic consumed in one cycle (including precharging, voltage difference detection and charge holding) in this internal voltage generating circuit varies depending on the voltage level of internal voltage Vrl. If internal voltage Vrl is higher than reference voltage Vrl0, MOS transistor 5 is kept in OFF state. In this case, current consumption Ic corresponds to charging and discharging current of the gate capacitance of the MOS transistors with gates receiving precharge instruction signal ZPRE and charge transfer instruction signal CT. Current consumption Ic is represented by the following equation where the total gate capacitance is Cga and the period of operation cycle is Tc.

$$Ic=Cga\cdot extVdd/Tc \quad (4)$$

Control signals ZPRE and CT vary between external supply voltage extVdd and the ground voltage. As shown in Equation (4), the total gate capacitance Cga is small enough and accordingly, current consumption Ic is a considerably small value.

If internal voltage Vrl is lower than reference voltage Vrl0, the discharging operation on capacitance element 6 via MOS transistor 5 causes voltage Vpg on node 11 to decrease. Current is consumed to recharge that node 11 for compensating for the decrease of the voltage thereat. Voltage Vpg on node 11 falls to internal voltage Vrl, and current consumption Ic is represented by the following equation.

$$Ic=(Cga\cdot extVdd)/Tc+(Cpg+Cg)\cdot(extVdd-Vthp-Vrl)/Tc= Cga\cdot extVdd/Tc+Ipg\ (av.) \quad (5)$$

Here, Ipg (av.) represents an average value of discharging current Ipg during a period T of T1<T<T2.

Figure 17:
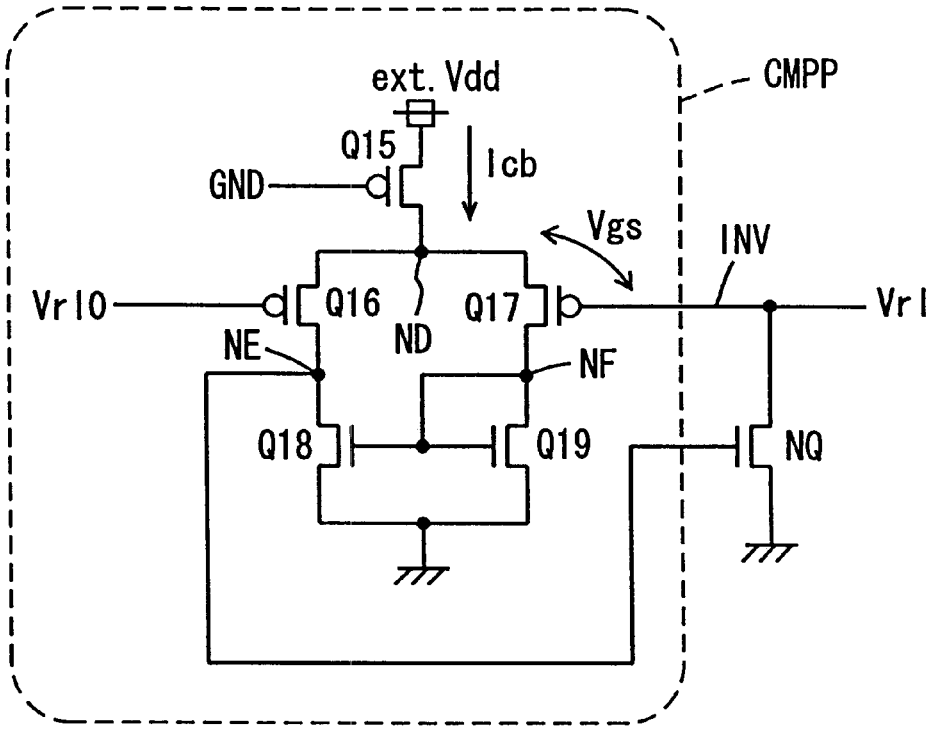
FIG. 17 PRIOR ART
FIG. 17 illustrates another structure of the conventional internal voltage generating circuit.

If the internal voltage generating circuit includes the comparator shown in FIG. 17, through current Icb of comparator CMPP should satisfy the following equation in order to have the same speed of response as that of the internal voltage generating circuit shown in FIG. 1A.

$$Icb=k\cdot Ipg\ (av.),\ K>1$$

Specifically, when comparator CMPP shown in FIG. 17 is employed, current should flow via MOS transistors Q16 and Q17. On the other hand, in the internal voltage generating circuit as shown in FIG. 1A, the discharging path is provided at MOS transistor 5 only, so that the factor K is greater than 1. Compared with the structure of the conventional internal voltage generating circuit as shown in FIG. 17, the current consumption can be decreased in the internal voltage generating circuit shown in FIG. 1A Especially, the current consumption is approximately 0 when internal voltage Vrl is higher than reference voltage Vrl0, and the current consumption can be decrease.

As heretofore discussed, in the internal voltage generating circuit according to the first embodiment of the invention, a slight change in the internal voltage is detected as the amount of change in charges of the precharged capacitance within a certain period, the amount of change in charge of the capacitance is amplified into the change in voltage, and the driving transistor is controlled based on the voltage change of the capacitance so as to cancel the change in the internal voltage. Consequently, the change in the internal voltage can be compensated for speedily and the current consumption can be reduced by converting the slight difference between the reference voltage and the internal voltage to a greater change in voltage using the capacitance element.

Figure 2A:
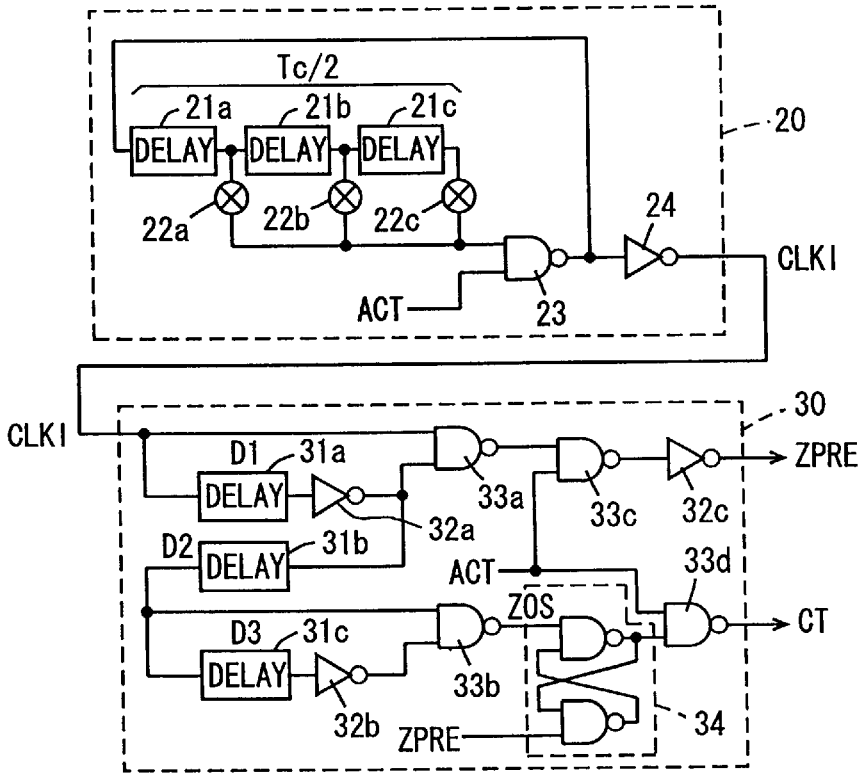
FIG. 2A illustrates a structure of a portion for generating control signals shown in FIG. 1A.

FIG. 2A illustrates a structure of a circuit for generating control signals shown in FIG. 1A. Referring to FIG. 2A, the control signal generating circuit includes an internal clock generating circuit 20 activated in response to activation instruction signal ACT to generate internal clock signal CLKI having a predetermined period, and a drive signal generating circuit 30 generating precharge instruction signal ZPRE and charge transfer instruction signal CT according to internal clock signal CLKI from internal clock generating circuit 20 and activation instruction signal ACT.

Internal clock generating circuit 20 includes delay circuits 21*a*–21*c* that are cascaded to each other, fuse elements 22*a*–22*c* provided to outputs of delay circuits 21*a*–21*c* respectively, an NAND circuit 23 receiving activation instruction signal ACT and a signal from either one of fuse elements 22*a*–22*c*, and an inverter 24 inverting an output signal of NAND circuit 23 to generate internal dock signal CLKI. The output signal of NAND circuit 23 is also supplied to delay circuit 21*a*.

Figure 14A:
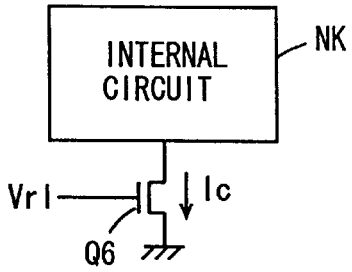
FIG. 14A PRIOR ART
FIGS. 14A and 14B illustrate usages of internal voltage.
Figure 14B:
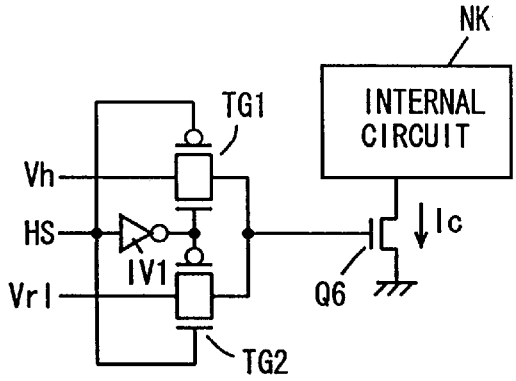
FIG. 14B PRIOR ART

Internal clock signal CLKI determines an operation cycle of the internal voltage generating circuit. If internal voltage Vrl is supplied to the gate of the MOS transistor as shown in FIGS. 14A and 14B, decrease in the voltage level of internal voltage Vrl is merely caused by the leakage current. In this case, a great current driving capacity and a high speed response characteristic are not required for the internal voltage generating circuit. Accordingly, the internal voltage generating operation cycle Tc is set to be long.

Figure 15A:
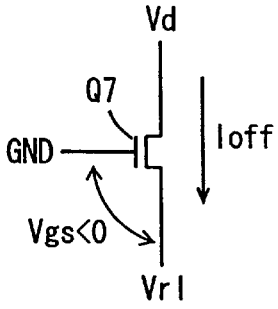
FIG. 15A PRIOR ART
FIGS. 15A and 15B illustrate other usages of the internal voltage, respectively.
Figure 15B:
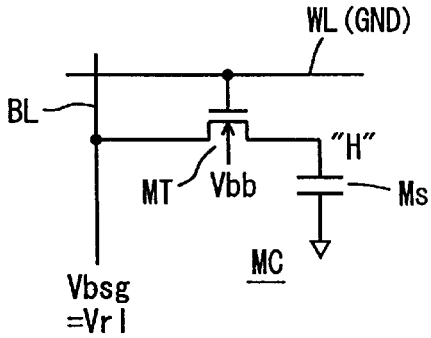
FIG. 15B PRIOR ART
Figure 16:
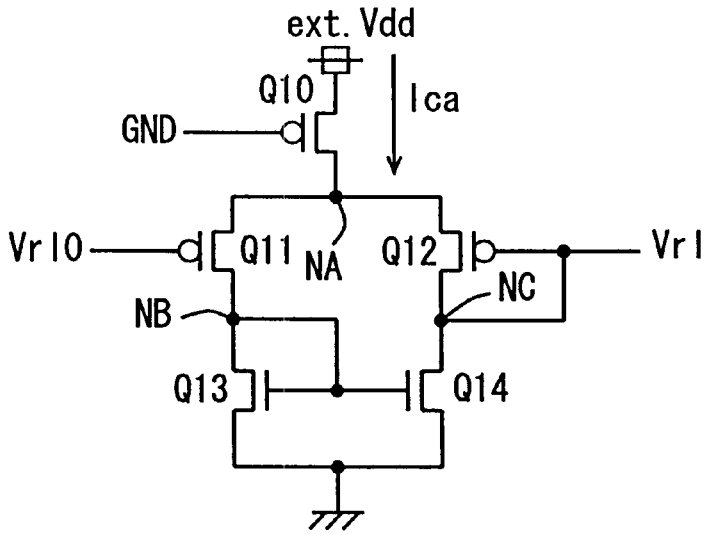
FIG. 16 PRIOR ART
FIG. 16 illustrates a structure of the conventional internal voltage generating circuit.

As shown in FIGS. 15A and 15B, if internal voltage Vrl is regularly consumed by the operation of the internal circuit, the operation cycle Tc should be set according to the operation of the internal circuit. Using delay circuits 21*a*–21*c* and fuse elements 22*a*–22*c*, the period of internal clock signal CLKI is programmed. NAND circuit 23 and delay circuits 21*a*–21*c* constitute a ring oscillator upon activation of activation instruction signal ACT, and the period of internal clock signal CLKI is determined by the delay time of delay circuits 21*a*–21*c* and the programmed delay time of NAND circuit 23. The delay time of the delay stages formed by delay circuits 21*a*–21*c* is programmed by fuse elements 22*a*–22*c*. In this case, the delay time of the delay stages is half the period of the operation cycle Tc when the delay time of NAND circuit 23 is neglected. The internal voltage generating operation cycle can be determined according to application.

Drive signal generating circuit 30 includes a delay circuit 31*a* delaying internal clock signal CLKI by time D1, an inverter 32*a* inverting an output signal of delay circuit 31*a*, an NAND circuit 33*a* receiving internal clock signal CLKI and an output signal of inverter 32*a*, an NAND circuit 33*c* receiving an output signal of NAND circuit 33*a* and activation instruction signal ACT, and an inverter 32*a* inverting an output signal of NAND circuit 33*c* to output the precharge instruction signal ZPRE. Precharge instruction signal ZPRE is set at L level during delay time D1 of delay circuit 31*a* in response to rising of internal clock signal CLKI.

Drive signal generating circuit 30 further includes a delay circuit 31*b* delaying the output signal of inverter 32*a* by time D2, a delay circuit 31*c* delaying an output signal of delay circuit 31*b* by time D3, an inverter 32*b* inverting the output signal of delay circuit 31*c*, an NAND circuit 33*b* receiving the output signal of delay circuit 31*b* and an output signal of inverter 32*b*, a flip-flop 34 set when an output signal ZOS of NAND circuit 33*b* is at L level and reset when precharge instruction signal ZPRE is at L level, and an NAND circuit 33*d* receiving an output signal of flip-flop 34 and activation instruction signal ACT to output the charge transfer instruction signal CT.

Figure 2B:
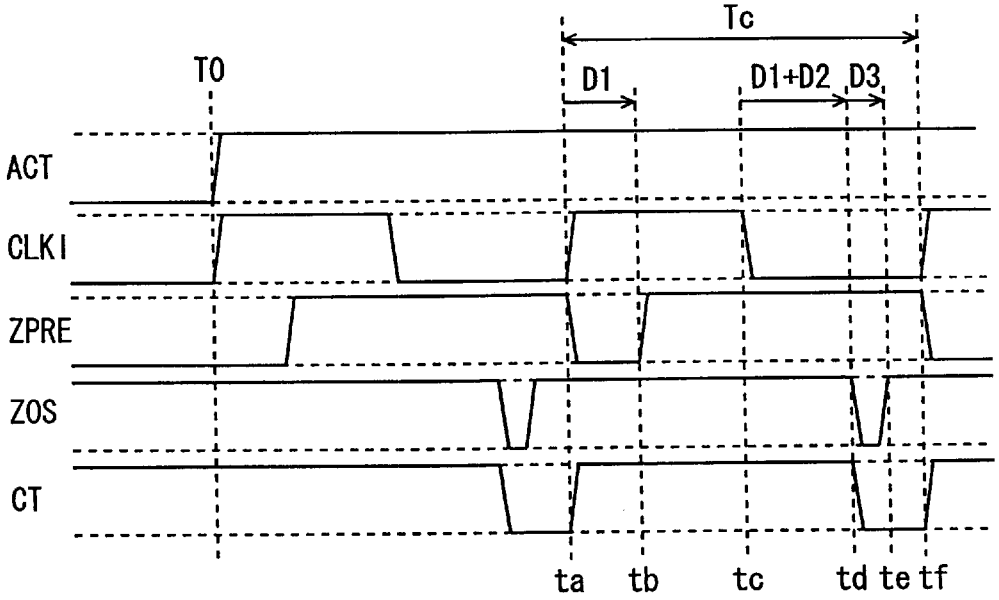
FIG. 2B is a timing chart representing an operation of the control signal generating circuit shown in FIG. 2A.

Upon activation of activation instruction signal ACT, charge transfer instruction signal CT falls to L level in response to falling of output signal ZOS of NAND circuit 33*b*, and attains H level in response to activation of precharge instruction signal ZPRE. An operation of the control signal generating circuit shown in FIG. 2A is now described in conjunction with the operation waveforms shown in FIG. 2B.

Before time T0, activation instruction signal ACT is in the inactive state of L level. In this state, the output signal of NAND circuit 23 in internal clock generating circuit 20 is fixed at H level, and internal clock signal CLKI supplied from inverter 24 is fixed at L level.

At time T0, activation instruction signal ACT is driven into the active state of H level. In response to activation of activation instruction signal ACT, the output signal of NAND circuit 23 in internal clock generating circuit 20 falls to L level, and internal clock signal CLKI from inverter 24 rises to H level. During a period in which activation instruction signal ACT is in the active state, NAND circuit 23 operates as an inverter, delay circuits 21*a*–21*c* and fuse elements 22*a*–22*c* constitute a ring oscillator, and accordingly internal clock signal CLKI having a period programmed by fuse elements 22*a*–22*c* is generated.

At time ta, internal clock signal CLKI rises to H level, the output signal of NAND circuit 33*a* falls to L level, precharge instruction signal ZPRE from NAND circuit 33*c* and inverter 32*c* accordingly falls to L level. When delay time D1 of delay circuit 31*a* has passed, the output signal of inverter 32*a* falls to L level, the output signal of NAND circuit 33*a* rises to H level, and accordingly, precharge instruction signal ZPRE from NAND circuit 33*c* and inverter 32*c* rises to H level. When activation instruction signal ACT is at H level, NAND circuit 33*c* operates as an inverter. Precharge instruction signal ZPRE falls to L level in response to rising of internal clock signal CLKI, and rises to H level after time D1 passes (time tb). Precharge instruction signal ZPRE is driven into the active state of L level periodically in response to internal clock signal CLKI.

After internal clock signal CLKI attains H level and times D1 and D2 passes, the output signal of delay circuit 31*b* falls to L level. Delay circuit 31*c*, inverter 32*b* and NAND circuit 33*b* constitute a one-shot pulse generating circuit. The output signal of delay circuit 31*b* rises to H level, signal ZOS from NAND circuit 33*b* accordingly falls to L level during delay time D3 (from time td to time te) of delay circuit 31*c*. Specifically, after internal clock signal CLKI falls to L level at time tc and times D1 and D2 pass, signal ZOS from NAND circuit 33*b* falls to L level, flip-flop 34 is set, and accordingly charge transfer instruction signal CT from NAND circuit 33*d* rise to L level. When precharge instruction signal ZPRE falls to L level at time tf, flip-flop 34 is reset and the output signal of flip-flop 34 falls to L level to cause charge transfer instruction signal CT from NAND circuit 33*d* to rise to H level. Delay time D1, D2 and D3 here satisfy the following relations.

$$Tc/2>D1+D2+d3,\ D1+D2>D3.$$

Owing to the above relations, when precharge instruction signal ZPRE falls to L level in response to rising of internal clock signal CLKI, output signal ZOS of NAND circuit 33*b* surely attains H level.

Charge transfer instruction signal CT is also activated/inactivated according to internal clock signal CLKI. In the precharging operation caused by activation of precharge instruction signal ZPRE, charge transfer instruction signal CT attains the active state of H level to ensure precharging of the capacitance element according to precharging instruction signal ZPRE. Further, it is possible to set the charge transfer instruction signal CT into the inactive state when precharge instruction signal ZPRE is in the inactive state, to cause the charge holding operation on the capacitance element.

According to the first embodiment of the invention, an internal voltage generating circuit stably generating internal voltage of a predetermined level with high-speed response and low current consumption is implemented by detecting the change in the internal voltage by the stored charges of the capacitance element and amplifying the change in the amount of charges by the change in the charged voltage of the capacitance element.

Second Embodiment

Figure 3A:
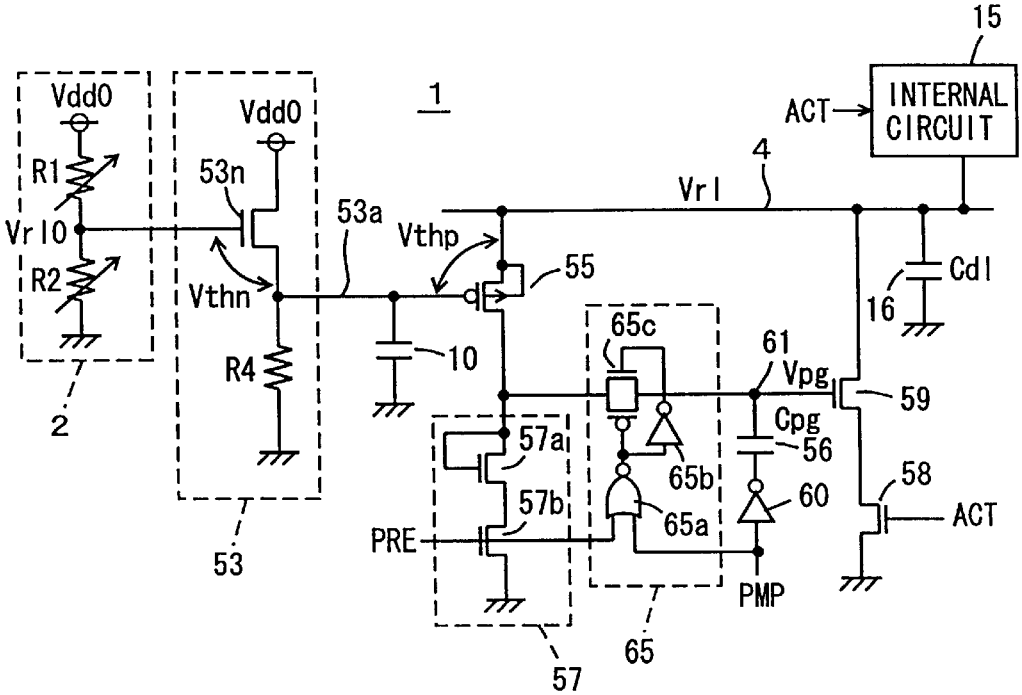
FIG. 3A illustrates a structure of an internal voltage generating circuit according to a second embodiment of the invention.

FIG. 3A illustrates a structure of an internal voltage generating circuit according to the second embodiment of the invention. Referring to FIG. 3A, internal voltage generating circuit 1 includes a reference voltage generating circuit 2 generating a reference voltage Vrl0, a level shift circuit 53 for shifting the level of reference voltage Vrl0, a p channel voltage difference detecting MOS transistor 55 causing a current according to the difference between a voltage on output node 53*a* of level shift circuit 53 and an internal voltage Vrl on an internal voltage line 4 to a node 61, a precharge circuit 57 precharging the node 61 to a predetermined voltage in response to a precharge instruction signal PRE, a capacitance element 56 having one electrode node connected to node 61 and the other electrode node receiving a pump signal PMP via an inverter 60, a charge holding circuit 65 for holding charges on node 61 according to precharge instruction signal PRE and pump signal PMP, an n channel driving MOS transistor 59 for sinking a current from internal voltage line 4 according to voltage Vpg on node 61, and an n channel MOS transistor 58 turned on in response to activation instruction signal ACT of an internal circuit 15 to form a current path between MOS transistor 59 and a ground node. Internal voltage line 4 is connected to a stabilizing capacitance 16 and a stabilization capacitance 10 is connected to a node 53*a*.

Reference voltage generating circuit 2 has the structure similar to that of reference voltage generating circuit 2 in the first embodiment and capable of adjusting the voltage level of reference voltage Vrl0 by fuse t programming of variable resistance elements R1 and R2.

Level shift circuit 53 includes an n channel MOS transistor 53*n* connected between a supply node and internal node 53*a* and having its gate receiving reference voltage Vrl0, and a resistance element R4 of high resistance connected between internal node 53*a* and the ground node. Level shift circuit 53 is merely required to charge the gate capacitance of MOS transistor 55 and the current consumption thereof is sufficiently small. The resistance value of resistance element R4 is sufficiently higher than a channel resistance (ON resistance) of MOS transistor 53*n*, and MOS transistor 53*n* operates in the source follower mode. Accordingly, voltage Vrl0−Vthn is present on node 53*a*.

MOS transistor 55 has its gate connected to node 53*a*, its source and back gate connected to internal voltage line 4, and its drain connected to node 61. Therefore, MOS transistor 55 is turned on when voltage Vrl on internal voltage line 4 becomes higher than the voltage on node 53*a* by (absolute value of) the threshold voltage Vthp to cause a current flow from internal voltage line 4 to internal node 61. According to the gate-source voltage of MOS transistor 55, the drain (source) current of MOS transistor 55 is determined, and the current according to the difference between the voltage on node 53*a* and the voltage on the internal voltage line, i.e. change in internal voltage Vrl can be flown via MOS transistor 55.

Precharge circuit 57 includes n channel MOS transistors 57*a* and 57*b* connected in series between node 61 and the ground node. MOS transistor 57*a* has its gate and drain connected to each other, and operates in the diode mode, when it is turned on, to cause voltage drop of the threshold voltage Vthn. MOS transistor 57*b* receives the precharge instruction signal PRE at its gate.

Charge holding circuit 65 includes an NOR circuit 65*a* receiving the precharge instruction signal PRE and pump signal PMP, an inverter 65*b* inverting an output signal of NOR circuit 65*a*, and a transmission gate 65*c* selectively rendered conductive in response to output signals of NOR circuit 65*a* and inverter 65*b*. Transmission gate 65*c* enters the nonconductive state when both signals PRE and PMP are at L level to hold the charges of node 61.

Pump signal PMP has an amplitude of an external supply voltage extVdd. Therefore, inverter 60 receives the external supply voltage extVdd as one operating supply voltage.

Figure 3B:
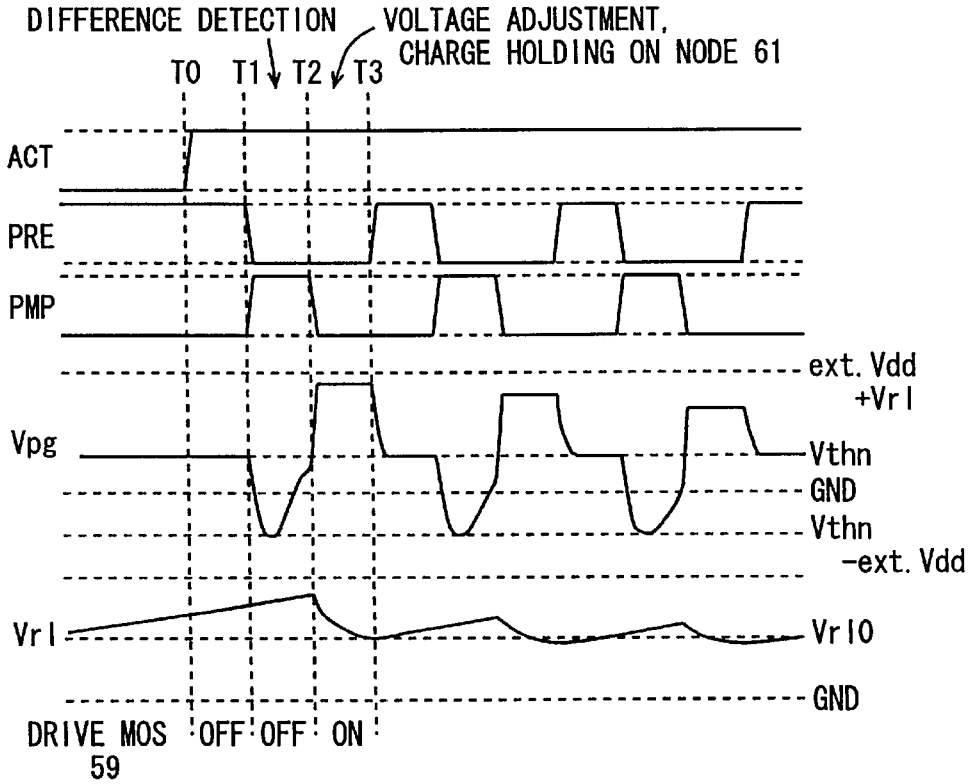
FIG. 3B is a signal waveform chart representing an operation of the circuit shown in FIG. 3A.

Internal voltage Vdd0 is at a constant voltage level independent of external supply voltage extVdd. An operation of the internal voltage generating circuit shown in FIG. 3A is now described in conjunction with the signal waveforms illustrated in FIG. 3B.

Suppose that internal voltage Vrl on internal voltage line 4 has its level increased by the leakage current from the supply node in the standby state of internal circuit 15. Since internal circuit 15 is in the standby state, activation instruction signal ACT is in the inactive state of L level, precharge instruction signal PRE is fixed in the active state of H level and pump signal PMP is fixed at L level. In this state, transmission gate 65*c* of charge holding circuit 65 is in the conductive state, so that internal node 61 is discharged by precharge circuit 57 and voltage Vpg on internal node 61 is maintained at the voltage level of threshold voltage Vthn of MOS transistor 57*a*.

Even if internal voltage Vrl increases to cause current to flow via MOS transistor 55, the current from MOS transistor 55 is discharged via precharge circuit 57 because precharge instruction signal PRE is at H level. The current driving ability of precharge circuit 57 is made higher than the current supplying ability of MOS transistor 55. The current driving ability of MOS transistor 55 and that of precharge circuit 57 are made inferior to that of driving n channel MOS transistor 59. Therefore, increase in internal voltage Vrl cannot be avoided.

When internal voltage Vrl is higher than a predetermined voltage level, activation instruction signal ACT is activated at time T0 to cause an operation of internal circuit 15. From time T0 to time T1, precharge instruction signal PRE is at H level and pump signal PMP is at L level so that the previous state is maintained and internal voltage Vrl continues to rise.

When internal voltage Vrl attains the voltage level as represented by the following INEquation (6), MOS transistor 55 attains ON state.

$$Vrl > Vrl0 - Vthn + Vthp \quad (6)$$

The temperature characteristics of threshold voltages Vthp and Vthn are the same and thus the temperature characteristics can be canceled. Resistance elements Ri and R2 of reference voltage generating circuit 2 are trimmed to adjust the voltage level of reference voltage Vrl0, and the voltage difference between threshold voltages Vthp and Vthn can be cancelled. The relation of Vthp=Vthn is hereinafter assumed to be satisfied for simplification of the description. Specifically, when internal voltage Vrl exceeds reference voltage Vrl0, MOS transistor 55 is turned on to supply current from internal voltage line 4 to node 61.

When precharge instruction signal PRE attains the inactive state of L level at time T1, pump signal PMP rises to external supply voltage extVdd level accordingly. In response to the rising of pump signal PMP, the output signal of inverter 60 falls to the ground voltage level, and capacitance coupling (charge pump operation) of capacitance element 56 causes the voltage Vpg on node 61 to fall (in precharge circuit 57, MOS transistor 57*b* is in OFF state). Specifically, voltage Vpg changes from precharge voltage Vthn in the negative direction by the amplitude of pump signal PMP. Pump signal PMP causes the voltage Vpg to fall temporarily to the voltage level of Vthn−extVdd. When the voltage level on node 61 falls to the negative voltage level, the current from MOS transistor 55 charged the capacitance element 56 to increase the voltage level of charging voltage Vpg since transmission gate 65*c* is in the conductive state.

At time T2, pump signal PMP falls to L level and the output signal of inverter 60 rises to external supply voltage extVdd level. Accordingly, the charge pump operation of capacitance element 56 raises the voltage Vpg on node 61 by external supply voltage extVdd level. At this time, the level of voltage Vpg is determined by the amount of charges accumulated from time T1 to time T2. If the difference between internal voltage Vrl and reference voltage Vrl0 is large, a great amount of charges is supplied by MOS transistor 55 to capacitance element 56 and the level of voltage Vpg is increased. After pump signal PMP falls, the level which voltage Vpg on node 61 reaches is determined according to the difference between internal voltage Vrl and reference voltage Vrl0. When pump signal PMP falls to L level, in charge holding circuit 65, the output signal of NOR circuit 65*a* attains H level, transmission gate 65*c* enters the nonconductive state, the accumulated charges of node 61 are maintained, and the level of voltage Vpg on node 61 at this time is maintained.

Driving MOS transistor 59 discharges, when voltage Vpg on internal node 61 becomes higher than its threshold voltage Vthn, the current from internal voltage line 4 to the ground node according to voltage Vpg on node 61 to immediately decrease the internal voltage Vrl. During this period, precharge instruction signal PRE is in the inactive state of L level, difference detecting MOS transistor 55 drives current in parallel with the discharging operation of current drive transistor 59. However, the driving current is a very small one and the discharging current sharply decreases due to quick decrease in internal voltage Vrl caused by discharging of driving MOS transistor 59. Voltage Vpg on node 61 is maintained at a constant level during this discharging period, that is, during the period between time T2 and time T3 by charge holding circuit 65.

The amount of charges Qpg flowing into capacitance element 56 at time T=T' (T'<T2) is represented by an equation which is the same as the one described illustrated in the first embodiment. Therefore, voltage Vpg at time T=T' is represented by Equation (7) shown below.

$$Vp=gVthn-extVdd+Qpg/Cpg \quad (7)$$

The reason why gate capacitance Cg is not included in Equation (7) differently from equation (2) is that when charges flow from MOS transistor 55 into capacitance element 56, MOS transistor 59 is in OFF state and no channel is formed therein and accordingly there is no gate capacitance. (Suppose herein that the gate capacitance is the one formed by the gate electrode, the gate insulating film and the channel.)

As understood clearly from Equation (7) shown above, the level of voltage Vpg changes considerably in accordance with a slight change in charge amount Qpg by setting capacitance value Cpg of capacitance element 56 at a small value. In other words, a slight change in internal voltage Vrl can be amplified to a great amount of change in charged voltage Vpg of capacitance element 56.

Voltage Vpg in Equation (7) assumes the maximum value when voltage Vpg becomes equal to internal voltage Vrl at time T=T2.

If internal voltage Vrl is lower than reference voltage Vrl0, no current flows through MOS transistor 55. In this state, voltage Vpg is maintained at voltage Vpg=Vthn−extVdd produced by pump signal PMP. This is obtained by substituting Qpg with 0 in Equation (7).

During the period from time T2 to time T3, capacitance element 56 responds to falling of pump signal PMP to perform a charge pump operation according to the output signal of inverter 60 so that voltage on node 61 increases. If internal voltage Vrl is higher than reference voltage Vrl0, the level further increases from the voltage level represented by Equation (7) by external supply voltage extVdd level, and accordingly voltage Vpg is represented by the following Equation (8).

$$Vpg=Vthn+Qpg/Cpg \quad (8)$$

The voltage level of voltage Vpg is higher than the threshold voltage of MOS transistor 59 so that MOS transistor 59 is turned on to decrease internal voltage Vrl through by its discharging operation. Driving MOS transistor 59 has its current driving ability set high enough to reduce the internal voltage Vrl speedily.

Voltage Vpg rises to extVdd+Vrl voltage level at the maximum. This maximum voltage level is higher than the level of external supply voltage extVdd so that the current driving power of MOS transistor 59 considerably increases to speedily reduce the internal voltage Vrl.

On the other hand, if internal voltage Vrl is lower than reference voltage Vrl0 in the period from time T2 to time T3, voltage Vpg on node 61 returns to the original precharge voltage Vthn level and driving MOS transistor 59 maintains OFF state.

At time T3, when precharge instruction signal PRE rises to H level, transmission gate 65*c* of charge holding circuit 65 becomes conductive and activated precharge circuit 57 discharges the voltage Vpg on node 61 forcefully to the voltage Vthn level. Consequently, driving MOS transistor 59 is prevented from discharging the internal voltage line 4 with a large current driving power to cause undershooting of internal voltage Vrl.

Even if internal voltage Vrl is lower than reference voltage Vrl0, voltage Vpg on node 61 should be swung by external supply voltage extVdd by pump signal PMP.

Therefore, current consumption Ic of the circuit shown in FIG. 3A is represented by a following Equation (9).

$$Ic=(Cpg+Cgb)\cdot extVdd/Tc \quad (9)$$

where Cgb represents the total of the gate capacitances of MOS transistors 57*b* and 58 which receive precharge instruction signal PRE and activation instruction signal ACT, respectively. The amplitudes of precharge instruction signal PRE and activation instruction signal ACT supplied to MOS transistors 57*b* and 58 are assumed to be external supply voltage extVdd level. This is because voltage Vpg on internal node 61 should reliably be discharged at a high speed in precharge circuit 57 since voltage Vpg could become higher than the external supply voltage. However, the amplitudes of precharge instruction signal PRE and activation instruction signal ACT supplied to the internal voltage generating circuit may be the internal supply voltage level.

By activating the precharge instruction signal PRE to set voltage Vpg on node 61 at precharge voltage Vthn, when node 61 is driven in a negative direction by pump signal PMP, the potential which the voltage Vpg attains can be set at the same level in each cycle. Consequently, OFF state of driving MOS transistor 59 is ensured, charges according to the difference between internal voltage Vrl and reference voltage Vrl0 can be accumulated in capacitance element 59, and the voltage difference detection and amplifying operation can correctly be performed.

When voltage Vpg is increased by pump signal PMP, the voltage level which the voltage Vpg attains is at a level according to the difference between internal voltage Vrl and reference voltage Vrl0. Accordingly, with the current driving power according to the voltage difference driving MOS transistor 59 can discharge internal voltage line 4 to prevent occurrence of undershooting (since the state of discharging a small voltage difference with the great current driving power does not occur).

Figure 4A:
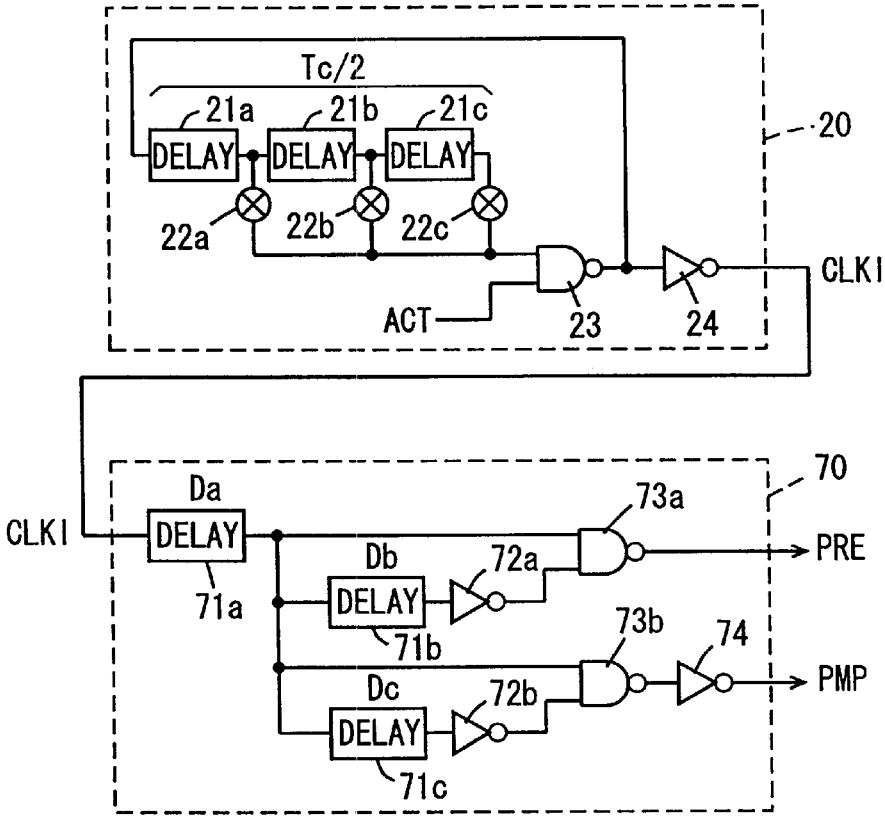
FIG. 4A illustrates a structure of a portion for generating control signals shown in FIG. 3A.

FIG. 4A illustrates a portion for generating control signals shown in FIG. 3A. Referring to FIG. 4A, a control signal generating circuit includes an internal clock generating circuit 20 activated upon activation of activation instruction signal ACT to generate internal clock signal CLKI, and a drive signal generating circuit 70 for generating one-shot pulse signals according to internal clock signal CLKI from internal clock generating circuit 20 to produce the precharge instruction signal PRE and pump signal PMP. The structure of internal clock generating circuit 20 is similar to that of the internal clock generating circuit shown in FIG. 2A, and the same reference characters are allocated to corresponding components and detailed description thereof is not repeated. Programming (fuse blowing) of fuse elements 22*a*–22*c* determines a period Tc of internal clock signal CLKI.

Drive signal generating circuit 70 includes a delay circuit 71*a* delaying internal clock signal CLKI by time Da, a delay circuit 71*b* delaying an output signal of delay circuit 71*a* further by time Db, an inverter 72*a* inverting an output signal of delay circuit 71*b*, an NAND circuit 73*a* receiving an output signal of inverter 72*a* and the output signal of delay circuit 71*a* to generate the precharge instruction signal PRE, a delay circuit 71*c* delaying the output signal of delay circuit 71*a* further by time Dc, an inverter 72*b* inverting an output signal of delay circuit 71*c*, an NAND circuit 73*b* receiving an output signal of inverter 72*b* and the output signal of delay circuit 71*a*, and an inverter 74 inverting an output signal of NAND circuit 73*b* to generate the pump signal PMP.

Figure 4B:
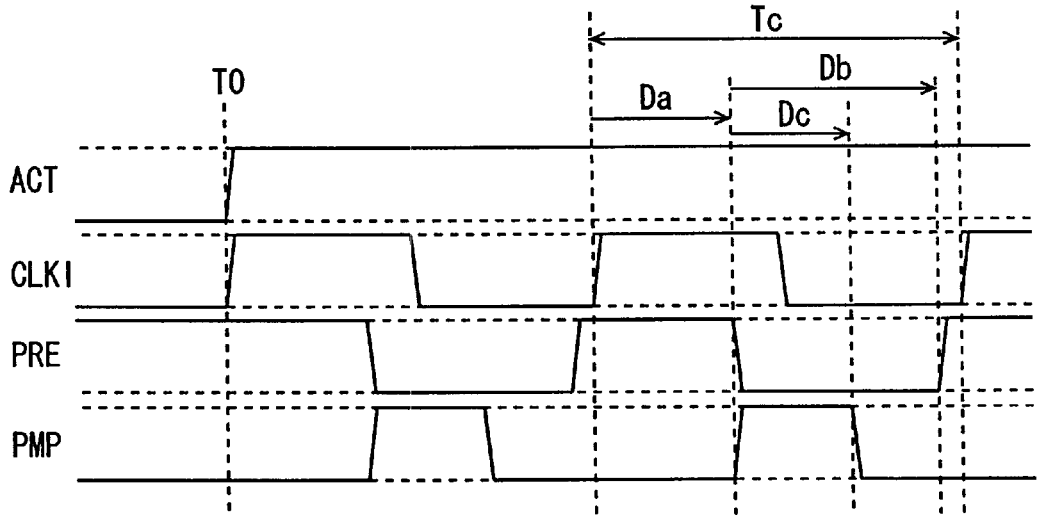
FIG. 4B is a timing chart representing an operation of the circuit shown in FIG. 4A.

An operation of the control signal generating circuit shown in FIG. 4A is now described in conjunction with operation waveforms illustrated in FIG. 4B.

Before time T0, activation instruction signal ACT is in the inactive state of L level and internal clock signal CLKI is fixed at L level. In this state, precharge instruction signal PRE is at H level and pump signal PMP is fixed at L level.

At time T0, activation instruction signal ACT is driven into the active state of H level. In response to activation of activation instruction signal ACT, internal clock signal CLKI is generated at a predetermined period Tc. After internal clock signal CLKI rises to H level and delay time Da of delay circuit 71*a* passes, NAND circuit 73*a* has both inputs risen to H level and accordingly drives the precharge instruction signal PRE to L level. When the output signal of delay circuit 71*b* attains H level after the output signal of delay circuit 71*a* rises to H level, precharge instruction signal PRE is driven from L level to H level. Accordingly, precharge instruction signal PRE is at L level during the period of delay time Db of delay circuit 71*b*.

When the output signal of delay circuit 71*a* rises to H level, the output signal of NAND circuit 73*b* falls to L level, and accordingly pump signal PMP from inverter 74 is driven into H level. When delay time Dc of delay circuit 71*c* passes, the output signal of inverter 72*b* attains L level, and accordingly pump signal PMP from inverter 74 is driven to L level. Pump signal PMP is driven to H level during the period of delay time Dc of delay circuit 71*c*.

Falling of precharge instruction signal PRE to L level and rising of pump signal PMP to H level are synchronous with each other. Therefore, when precharge instruction signal PRE falls to L level and node 61 is isolated from the ground node, voltage Vpg on node 61 can be driven to the negative voltage level according to pump signal PMP. In each cycle, charging start voltage level can be set at a constant voltage level. Delay time Da of delay circuit 71*a* is provided in order to stably perform the voltage difference detection and adjustment operation after the internal circuit starts to operate as in the first embodiment.

According to the second embodiment, the slight change in the internal voltage is detected by the amount of change in charges of the capacitance element and the slight change is amplified to the change in the charged voltage of the capacitance element, and accordingly, the internal voltage is discharged with the charged voltage via the drive transistor. Consequently, increase in internal voltage can be detected to drive the internal voltage to a predetermined voltage level with low current consumption and high sensitivity.

Further, the gate voltage of the driving MOS transistor is driven to a voltage level according to the voltage difference by means of inverter 60, so that the MOS transistor for voltage difference detection can be set in OFF state during this period to adjust the level of the internal voltage efficiently via the driving MOS transistor. Accordingly, the gate voltage of the driving MOS transistor can be efficiently driven into a desired state depending on the precharge period, the voltage difference detection period, and the voltage adjustment period without increase in the circuit occupation area.

Third Embodiment

Figure 5:
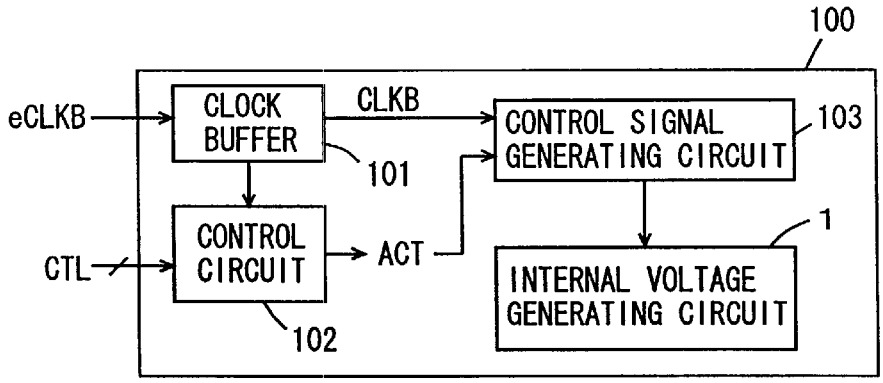
FIG. 5 schematically illustrates an entire structure of a semiconductor device according to a third embodiment of the invention.

FIG. 5 is a diagram showing the entire structure of a semiconductor device according to the third embodiment of the invention. Referring to FIG. 5, the semiconductor device 100 includes a clock buffer 101 buffering externally supplied clock signal eCLKB to generate an internal clock signal CLKB, a control circuit 102 operating in synchronization with the internal clock signal from clock buffer 101 to generate an internal control signal according to externally supplied control signal CTL, and a control signal generating circuit 103 for generating a control signal for an internal voltage generating circuit 1 according to activation instruction signal ACT from control circuit 102 and internal clock signal CLKB from clock buffer 101.

Semiconductor device 100 shown in FIG. 5 generates the internal clock signal CLKB according to externally supplied clock signal eCLKB, and determines the operation timing of the internal circuit with internal clock signal CLKB used as a basic clock signal. Control signal generating circuit 103 generates various control signals that are necessary, using internal clock signal CLKB.

Figure 6:
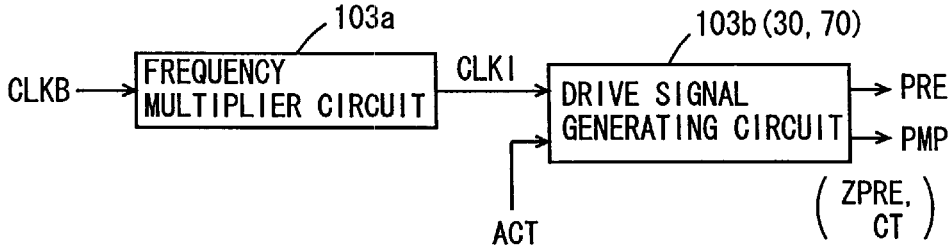
FIG. 6 schematically illustrates a control signal generating circuit shown in FIG. 5.

FIG. 6 is a diagram showing a structure of control signal generating circuit 103. Referring to FIG. 6, control signal generating circuit 103 includes a frequency multiplier circuit 103*a* for frequency-multiplying internal clock signal CLKB, and a drive signal generating circuit 103*b* for supplying a control signal for the internal voltage generating circuit according to clock signal CLKI from frequency multiplier circuit 103*a* and activation instruction signal ACT. Drive signal generating circuit 103*b* corresponds to drive signal generating circuits 30 and 70 respectively in the first and second embodiments, and generates signals PRE and PMP or ZPRE and CT.

The operation cycle of the internal voltage generating circuit is defined using internal clock signal CLKB from clock buffer 101. Therefore, no ring oscillator is required and accordingly the circuit scale and current consumption can be reduced.

Figure 7:
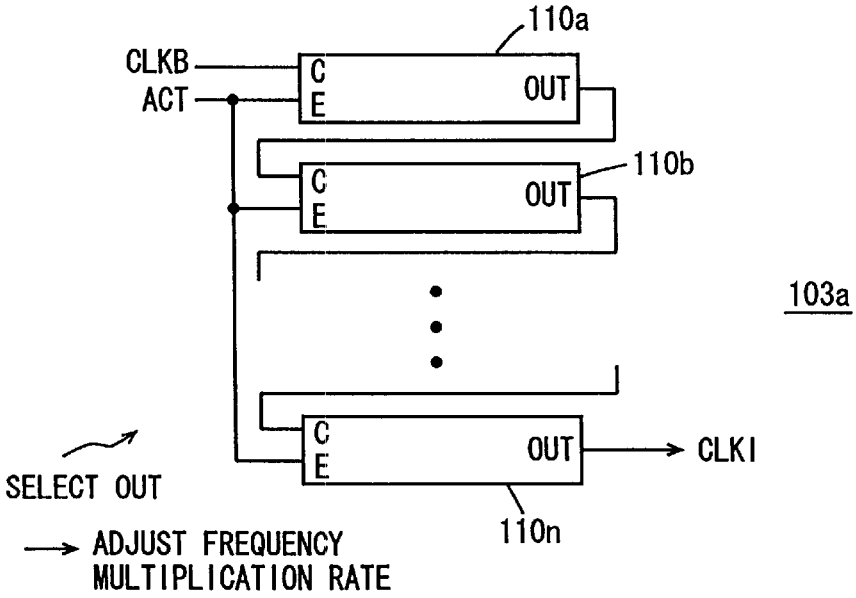
FIG. 7 schematically illustrates a structure of a frequency multiplier circuit shown in FIG. 6.

FIG. 7 is a schematic diagram showing a structure of frequency multiplier circuit 103*a* shown in FIG. 6. Referring to FIG. 7, frequency multiplier circuit 103*a* includes a plurality of cascaded frequency dividers 110*a*–110*n*. Frequency dividers 110*a*–110*n* have the same structure and each include an output node OUT outputting a frequency-divided signal, an enable node E receiving the activation instruction signal ACT, and a clock input C receiving a clock signal supplied from the preceding stage. Each of dividers 110*a*–110*n* frequency-divides a clock signal supplied to clock input C and supplies the resultant one from output OUT. Therefore, the multiplication factor (frequency division rate) of the output clock signal increases in the order of frequency dividers from 110*a* to 110*n*.

In the structure shown in FIG. 7, clock signal CLKI is obtained from frequency divider 110*n* in the final stage. However, the frequency division rate of frequency multiplier circuit 103*a* can be made programmable by selectively receiving a clock signal supplied from any of frequency dividers 110*a*–110*n*. For example, the frequency multiplication rate can be programmed by providing CMOS transmission gates to the output nodes OUT of respective frequency dividers 110*a*–110*n* and selectively turning on the CMOS transmission gates. A signal for controlling conduction/nonconduction of the CMOS transmission gates may be programmed by the fuse element. Alternatively, a register circuit may be used to store the frequency division rate data, to generate a control signal according to the frequency division rate data.

Figure 8:
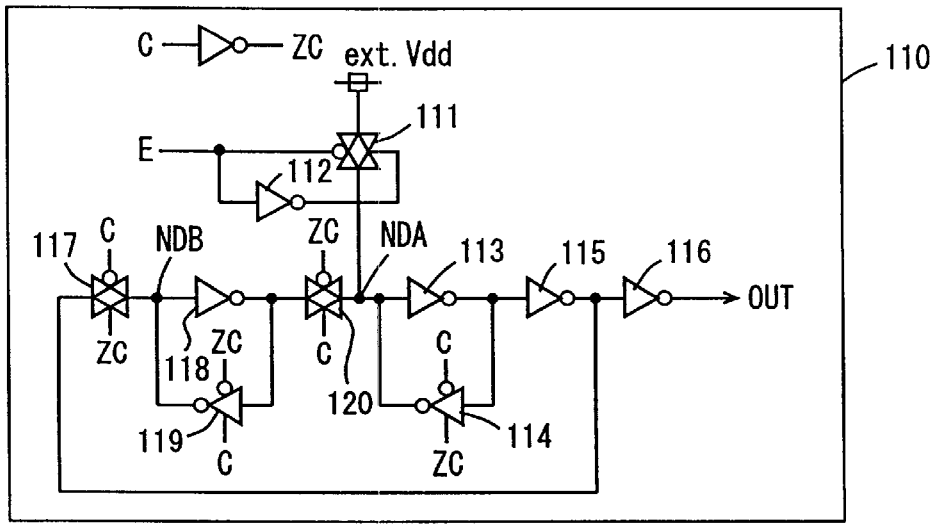
FIG. 8 illustrates a structure of a frequency divider shown in FIG. 7.

FIG. 8 illustrates a structure of frequency dividers 110*a*–110*n* shown in FIG. 7. FIG. 8 illustrates one frequency divider 110 as a representative.

Referring to FIG. 8, frequency divider 110 includes an inverter 112 inverting a signal supplied to enable input E, a transmission gate 111 coupling an external supply node to a node NDA according to an output signal of inverter 112 and a signal at enable input E, an inverter 113 inverting a signal on node NDA, a clocked inverter 114 activated according to a signal on clock input C to transmit an output signal of inverter 113 to node NDA, an inverter 115 inverting an output signal of inverter 113, an inverter 116 inverting an output signal of inverter 115 to output a clock signal from output node OUT, a transmission gate 117 passing output signal of inverter 115 according to clock signals on clock inputs C and ZC, an inverter 118 inverting a signal transmitted from transmission gate 117 to node NDB, a clocked inverter 119 operating according to the clock r2 i signals on clock inputs C and ZC to transmit an output signal of inverter 118 to node NDB, and a transmission gate 120 made conductive selectively in response to signals on clock inputs C and ZC to transmit the output signal of inverter 118 to node NDA. Transmission gates 117 and 120 become conductive complementarily to each other.

Figure 9:
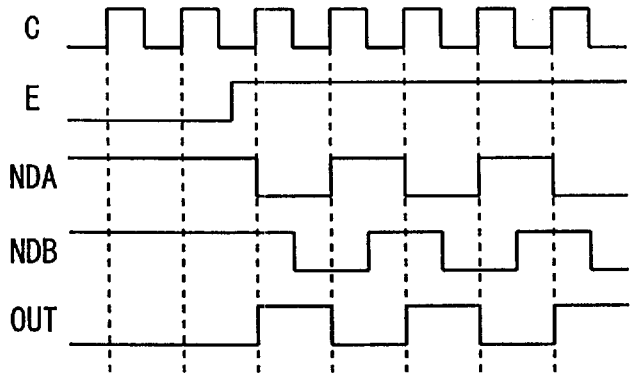
FIG. 9 is a timing chart representing an operation of the frequency divider shown in FIG. 8.

An operation of frequency divider 110 shown in FIG. 8 is now described in conjunction with an operation waveform chart shown in FIG. 9. Clock signals supplied to clock inputs C and ZC are those complementary to each other. When activation instruction signal (ACT) supplied to enable input E is at L level, transmission gate 111 becomes conductive and node NDA is maintained at H level corresponding to external supply voltage extVdd level. According to the signal on clock input C, transmission gates 117 and 120 become conductive complementarily to each other and the signal on node NDA is transmitted to node NDB, and node NDB is at H level.

When the activation instruction signal supplied to enable input E rises to H level, transmission gate 111 enters the nonconductive state and node NDA is isolated from the external supply node. When a clock signal supplied to clock input C (hereinafter referred to simply as clock signal) attains H level, transmission gate 120 becomes conductive so that a signal of L level from inverter 118 is transmitted to node NDA. Clocked inverter 114 is in an output high impedance state and accordingly the voltage level on node NDA falls to L level. On the other hand, transmission gate 117 is in the nonductive state and node NDB maintains H level. In response to falling of the signal on node NDA, the clock signal from output node OUT rises to H level. When clock signal C falls to L level, clocked inverter 114 starts to operate and L level on node NDA is latched. At this time, transmission gate 117 becomes conductive and transmission gate 120 enters the nonconductive state. The signal of L level from inverter 115 is transmitted to node NDB via transmission gate 117. As clocked inverter 119 is in the output high impedance state, the signal potential on node NDB falls to L level. Since transmission gate 120 is in the nonconductive state, node NDA maintains L level.

When clock signal C rises to H level, transmission gate 120 becomes conductive and a signal of H level from inverter 118 is transmitted to node NDA. At this time, clocked inverter 114 is in the output high impedance state and the voltage on node NDA attains H level. Transmission gate 117 is in the nonconductive state and node NDB maintains L level.

Next, when clock signal C falls to L level again, transmission gate 120 and transmission gate 117 respectively enter the nonconductive state and the conductive state, so that a signal of H level from inverter 115 is transmitted to node NDB to raise the voltage level on node NDB to H level.

After this, this operation is repeated, and node NDA is set at H level for one clock period and at L level for one clock period. Node NDB changes in voltage according to the signal change on node NDA with delay of half the period of clock signal C. Accordingly, the clock signal from output node OUT corresponds to the one obtained by dividing the frequency of the clock signal supplied to clock input C by a factor of 2. A frequency multiplier circuit with frequency division rate $(1/2)^M$ can be implemented by cascading frequency divider 110 by M in number.

By appropriately selecting the output OUT from wither one of frequency dividers 110*a*–110*n* as described above, internal clock signal CLKI produced by frequency dividing the basic clock signal CLKB by a factor of the power of 2 can be obtained.

According to the third embodiment of the invention, as discussed above, the frequency of the externally supplied clock signal is internally multiplied to generate the internal clock signal of determine the cycle of the internal voltage generating operation. Consequently, a ring oscillator for internally generating a clock signal for determining an operation cycle is unnecessary, so that the circuit occupation area and current consumption can be reduced.

Fourth Embodiment

Figure 10:
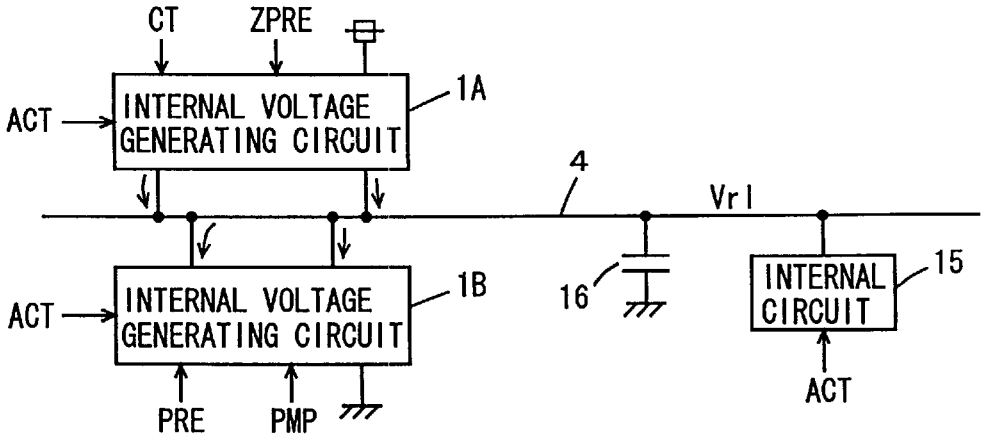
FIG. 10 schematically illustrates a structure of a semiconductor device according to a fourth embodiment of the invention.

FIG. 10 is a schematic diagram showing a structure of a semiconductor device according to the fourth embodiment of the invention. In the structure shown in FIG. 10, an internal voltage generating circuit 1A for compensating for decrease in internal voltage Vrl on an internal voltage line 4 and an internal voltage generating circuit 1B for compensating for increase in internal voltage Vrl are provided to internal voltage line 4. Internal voltage generating circuit 1A has the structure as shown in FIG. 1A, and supplies current from an external supply node to internal voltage line 4 when internal voltage Vrl becomes lower than a predetermined voltage level upon activation of activation instruction signal ACT to increase the voltage level of internal voltage Vrl.

If internal voltage Vrl is higher than the predetermined voltage level, internal voltage generating circuit 1B operates upon activation of activation instruction signal ACT, discharges the internal voltage Vrl on internal voltage line 4 to a ground node to drive the internal voltage Vrl to the predetermined voltage level. Internal voltage generating circuit 1B has the structure as shown in FIG. 3A related to the second embodiment.

As showing in FIG. 10, internal voltage generating circuits 1A and 1B for avoiding both of the increase and decrease of internal voltage Vrl are provided in order to maintain internal voltage Vrl at a predetermined voltage level in stably.

A structure as described below may be employed as the structure for avoiding the increase and decrease of internal voltage Vrl. Specifically, a circuit for preventing an increase in internal voltage Vrl is implemented by using the structure of the internal voltage generating circuit shown in FIG. 1A with the conductivity type of the precharge circuit, that of the MOS transistor for difference detection, and that of the MOS transistor for current drive reversed, and with the external supply node replaced with the ground node, and with the polarity of control signals reversed.

The internal voltage generating circuit shown in FIG. 3A functions as a circuit for preventing a decrease in internal voltage Vrl with the conductivity types of precharge circuit 57, current drive transistor 59, and difference detection MOS transistor 55 reversed, with the polarity of supplied control signals reversed, and with the ground node replacing the external supply node.

Fifth Embodiment

Figure 11A:
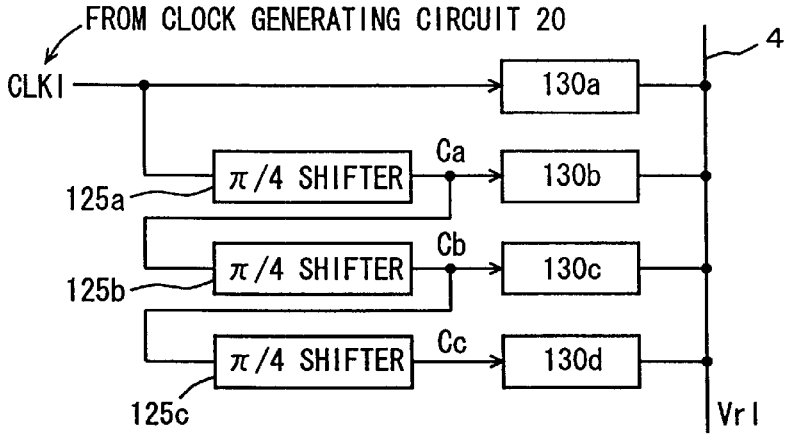
FIG. 11A schematically illustrates a structure of a semiconductor device according to a fifth embodiment of the invention.
Figure 11B:
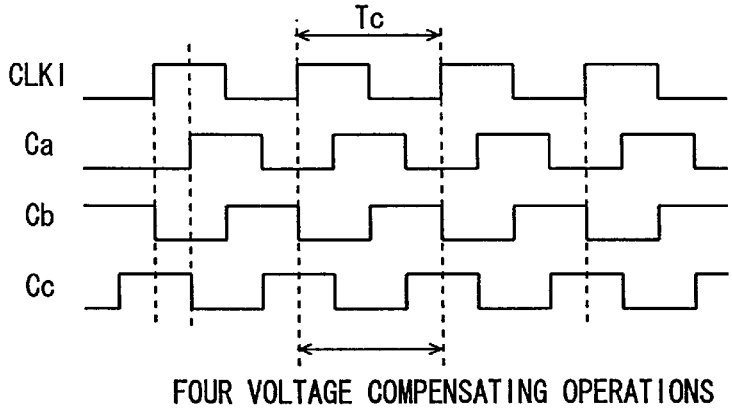
FIG. 11B is a timing chart illustrating an operation of the circuit shown in FIG. 11A.

FIG. 11A is a schematic diagram showing a structure of a semiconductor device according to the fifth embodiment of the invention. Referring to FIG. 11A, four internal voltage generating circuits 130*a*–130*d* operating in parallel with each other, and π/4 shifters 125*a*–125*c* shifting the phase of a supplied clock signal by 90° (π/4) to output the resultant one and corresponding to internal voltage generating circuits 130*b*–130*d* are provided.

Output clock signal Ca of π/4 shifter 125*a* is supplied to corresponding internal voltage generating circuit 130*b* and to the input of π/4 shifter 125*b*. Output clock signal Cb of π/4 shifter 125*b* is supplied to corresponding internal voltage generating circuit 130*c* and to the input of π/4 shifter 125*c*. Output clock signal Cc of π/4 shifter 125*c* is supplied to corresponding internal voltage generating circuit 130*d*. Clock signal CLKI is supplied to internal voltage generating circuit 130*a* and clock signal CLKI is supplied to π/4 shifter 125*a*. Therefore, clock signals CLKI, Ca, Cb and Cc have their phases each shifted by 90° to others. Each of internal voltage generating circuits 130*a*–130*d* includes the control signal generating circuit and the internal voltage generating circuit described in the first, second or fourth embodiment, and has its operation cycle determined by the supplied clock signal.

Internal voltage generating circuits 130*a*–130*d* perform the precharging, the voltage difference detection, and internal voltage line driving out of phase by 90° with each other. As shown in FIG. 11A, internal voltage generating circuits 130*a*–130*d* operate respectively according to clock signals CLKI, Ca, Cb and Cc having their phases shifted by 90° from each other, so that the control operation cycle for internal voltage Vrl on internal voltage line 4 is one fourth of cycle Tc of clock signal CLKI.

It is now supposed that the allowable range of change in internal voltage Vrl is ΔVa. If the change ΔVt in internal voltage Vrl with respect to time is equal to or more than ΔVa/Tc, it is difficult to absorb temporal change ΔVt within the one cycle period Tc and accordingly the speed of response of the internal voltage generating circuit is not satisfactory. What is required to reduce operation cycle period Tc is to increase, the value of current Ipg flowing via the transistor for voltage difference detection and to reduce the capacitance value Cpg of capacitance element (Cpg) 6 or 56 for generating the voltage Vpg which in turn can drive the current drive transistor sufficiently in a short period of time.

However, regarding MOS transistor 5 or 55 for voltage difference detection, allowable range ΔVa of internal voltage Vrl is small and accordingly it is difficult to secure a large difference between the gate-source voltage Vgs and the threshold voltage Vth (Vthn or Vthp). Accordingly, charging and discharging current Ipg for the capacitance element flowing via voltage difference detection MOS transistor 5 or 55 is relatively small. In order to increase the current Ipg flowing through voltage difference detection MOS transistor 5 or 55, the ratio between the channel width and the channel length, W/L, of the voltage difference detection MOS transistors 5 and 55 should be made considerably large, resulting in increase in the circuit occupation area. If the change in internal voltage Vrl is to be compensated for by one internal voltage generating circuit, internal voltage Vrl varies in a large sawtooth manner with respect to time.

However, as shown in FIG. 11A, if a plurality of (four in this embodiment) internal voltage generating circuits having the same structure are prepared and a clock signal for defining an operation cycle is supplied thereto with each clock phase shifted by 90°, the phases of the internal voltage correcting operations of the internal voltage generating circuits can be shifted by 90°. Consequently, the speed of response of the circuit viewed from internal voltage Vrl is equivalently Tc/4, and the change in internal voltage Vrl can be reduced to ¼ times, or ΔVt-(1/4)-Tc, as compared to the case where one internal voltage generating circuit are employed.

Figure 12A:
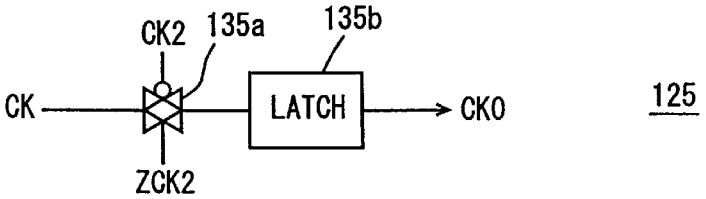
FIG. 12A illustrates an example of a structure of a $\pi/4$ shifter shown in FIG. 11A.

FIG. 12A is a schematic diagram showing one example of the structure of π/4 shifters 125*a*–125*c* shown in FIG. 11A. The π/4 shifters 125*a*–125*c* have the same structure, and FIG. 12A illustrates one π/4 shifter 125 as a representative.

Figure 12B:
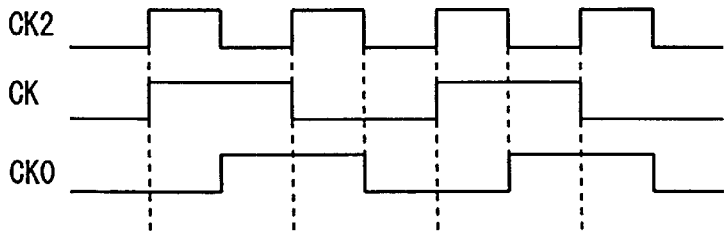
FIG. 12B is a timing chart representing an operation of the $\pi/4$ shifter shown in FIG. 12A.
Figure 13:
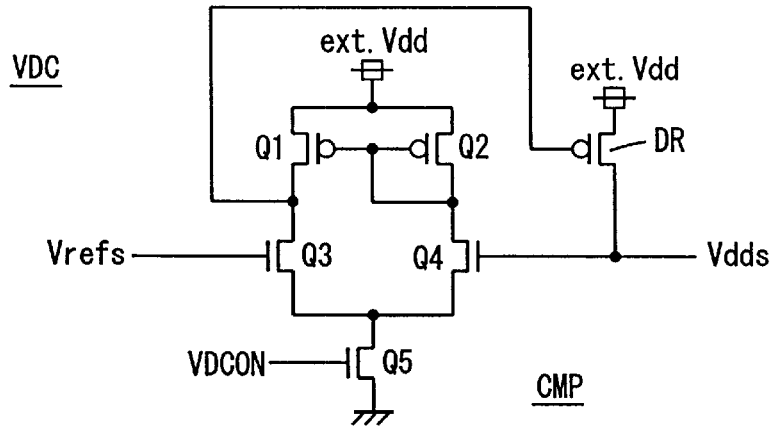
FIG. 13 PRIOR ART
FIG. 13 illustrates an example of a structure of a conventional internal voltage generating circuit.

Referring to FIG. 12A, π/4 shifter 125 includes a transmission gate 135*a* made conductive according to clock signals CK2 and ZCK2 to pass input clock signal CK, and a latch 135*b* for latching the clock signal passed through transmission gate 135*a* and supplying an output clock signal CKO. Clock signals CK2 and ZCK2 are complementary to each other and the frequencies of clock signals CK2 and ZCK2 are two times higher than that of input clock signal CK. An operation of π/4 shifter 125 shown in FIG. 12A is now described in conjunction with the operation waveforms shown in FIG. 12B.

Input clock signal CK and transfer clock signal CK2 are in phase with each other. When clock signal CK rises, transfer clock signal CK2 also rises to H level, transmission gate 135*a* enters the nonconductive state, and no change occurs in the state of output clock signal CKO of latch 135*b*. When transfer clock signal CK2 falls to L level, transmission gate 135*a* becomes conductive to pass the input clock signal CK. Accordingly, output clock signal CKO from latch 135*b* rises to H level. During the period in which transfer clock signal CK2 is at L level, input clock signal CK is at H level and output clock signal CKO maintains H level. When transfer clock signal CK2 attains H level synchronously with falling of input clock signal CK, transmission gate 135*a* enters the nonconductive state, and output clock signal CKO is isolated from input clock signal CK to maintain H level. Next, when transfer clock signal CK2 falls to L level, transmission gate 135*a* becomes conductive and output clock signal CKO from latch 135*b* falls to L level.

Accordingly, π/4 shifter 125 shown in FIG. 12A generates output clock signal CKO by transferring input clock signal CK with a delay of ½ cycle of transfer clock signal CK2 Transfer clock signal CK2 has the frequency two times higher than the frequency of input clock signal CK. Output clock signal CKO has its phase shifted by π/4 relative to that of input clock signal CK. If output clock signal CKO of the π/4 shifter shown in FIG. 12A is further delayed by phase π/4, the polarity of the transfer clock signal supplied to transmission gate 135*a* is reversed and transmission gate 135*a* is set into the conductive state when transfer clock signal CK2 is at H level. Consequently, a clock signal having its phase shifted by π/4 relative to output clock signal CKO can be obtained. Clock signals CK2 and ZCK2 are applied to the transmission gate such that the transmission gate of the input stage enters the nonconductive state upon rising of the input clock signal.

In the structure shown in FIG. 11A, four internal clock generating circuits are employed which operate in a time division multiplex manner. However, the number of internal voltage generating circuits operating in the time division multiplex manner is not limited to four, and two or eight internal voltage generating circuits may be employed.

As discussed above, according to the fifth embodiment of the invention, the operation phases of a plurality of internal voltage generating circuits are shifted to equivalently reduce the correcting operation cycle period of the internal voltage. As a result, the internal voltage can be maintained at a predetermined voltage level stably.

Another Application

Internal voltage Vrl discussed above is described as having a voltage level close to the ground voltage. However, the level of the internal voltage can be increased by increasing the voltage level of reference voltage Vrl0. Therefore, the present invention is applicable to an internal voltage having a relatively high level.

The internal circuit which consumes internal voltage Vrl is a sense amplifier circuit where the present invention is applied to a dynamic random access memory, and the bit line is discharged to internal voltage Vrl level.

Internal voltage Vrl may alternatively be utilized as a constant voltage supplied to the gate of a constant current source transistor.

According to the present invention, a slight change in the internal voltage is amplified through the change the accumulated charge amount of the capacitance element into the charged voltage of the capacitance element, and the level of the internal voltage is adjusted by the drive transistor according to the charged voltage of the capacitance element. An internal voltage generating circuit is implemented which can generate the internal voltage stably with a small occupation area and small current consumption.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device comprising:

an internal voltage line; and internal voltage generation circuitry for generating an internal voltage on said internal voltage line, said internal voltage generating circuitry including:

a reference voltage generating circuit for generating a reference voltage;

a capacitance element;

a difference detection circuit for changing a charged voltage of said capacitance element in a one-way direction according to a difference between said reference voltage from said reference voltage generating circuit and the internal voltage on said internal voltage line;

a current drive element having a control gate, for causing a current flow between a power supply node and said internal voltage line according to the charged voltage of said capacitance element, said capacitance element being coupled with the control gate of the current drive element; and a precharge circuit for precharging the control gate of the current drive element through precharging of said capacitance element to a predetermined voltage to make the current drive element non-conductive in response to a precharge instruction.

2. The semiconductor device according to claim 1, wherein said difference detection circuit includes an insulated gate field effect transistor for causing a current flow according to the difference between said reference voltage and said internal voltage.

3. The semiconductor device according to claim 1, wherein said internal voltage generating circuitry further includes a charge holding circuit for isolating said capacitance element from said difference detection circuit in response to a control signal.

4. The semiconductor device according to claim 1, wherein said precharge circuit couples said capacitance element to said power supply node and isolates said capacitance element and the control gate of the current drive element from said difference detection circuit in response to said precharge instruction.

5. The semiconductor device according to claim 1, wherein said precharge circuit isolates said difference detection circuit from said capacitance element in response to inactivation of a first control signal, and couples said capacitance element to said power supply node and isolates said capacitance element from said difference detection circuit in response to activation of a second control signal, said first control signal is activated in response to activation of said second control signal and said first control signal is inactivated after an elapse of a predetermined time from inactivation of said second control signal, and said precharge instruction includes said first and second control signals.

6. The semiconductor device according to claim 1, wherein said precharge circuit couples said capacitance element and the control gate of the current drive element to said power supply node in response to said precharge instruction.

7. The semiconductor device according to claim 6, further comprising a circuit for applying a pulse signal to said capacitance element in response to inactivation of said precharge instruction, said pulse signal being transmitted via said capacitance element to said control gate of said current drive element.

8. The semiconductor device according to claim 1, further comprising:

an internal circuit activated in response to an activation instruction signal to operate and consume the internal voltage on said internal voltage line; and an enabling circuit for enabling voltage difference detection operation of said difference detection circuit and a charging operation on said capacitance element in accordance with said activation instruction signal.

9. The semiconductor device according to claim 1, further comprising a circuit for enabling the difference detection operation and the charging operation on said capacitance element according to a clock signal, said clock signal being applied to the circuit for generating.

10. The semiconductor device according to claim 1, wherein said current alive element causes the current flow from the power supply node to the internal voltage line when made conductive.

11. The semiconductor device according to claim 1, wherein said current drive element causes the current flow from the internal voltage line to the power supply node.

12. The semiconductor device according to claim 1, wherein the capacitance element is coupled between the control gate and a node supplying a predetermined potential.

13. A semiconductor device comprising:

an internal voltage line; and a plurality of internal voltage generation circuits, coupled to said internal voltage line, each for generating an internal voltage on said internal voltage line, each of said plurality of internal voltage generating circuits including:

a capacitance element;

a difference detection circuit for changing a charged voltage of said capacitance element according to a difference between a reference voltage and the internal voltage on said internal voltage line; and a current drive element having a control gate coupled to said capacitance element, for causing a current flow between a power supply node and said internal voltage line according to the charged voltage of said capacitance element;

said plurality of internal voltage generation circuits operating at timings different from each other to generate the internal voltage.

14. The semiconductor device according to claim 13, further comprising a circuit for shifting a phase of a clock signal having a predetermined period to supply a phase-shifted clock signal as an operation cycle defining signal to each of said plurality of internal voltage generating circuits, clock signals of different phases being applied to the respective internal voltage generating circuits.

* * * * *